US007403183B2

(12) United States Patent
Someya

(10) Patent No.: US 7,403,183 B2
(45) Date of Patent: Jul. 22, 2008

(54) IMAGE DATA PROCESSING METHOD, AND IMAGE DATA PROCESSING CIRCUIT

(75) Inventor: Jun Someya, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 1058 days.

(21) Appl. No.: 10/797,154

(22) Filed: Mar. 11, 2004

(65) Prior Publication Data

US 2004/0189565 A1 Sep. 30, 2004

(30) Foreign Application Priority Data

Mar. 27, 2003 (JP) ..... 2003-087617
Sep. 11, 2003 (JP) ..... 2003-319342

(51) Int. Cl.
*G09G 3/36* (2006.01)

(52) U.S. Cl. ..... 345/98; 345/87; 345/204

(58) Field of Classification Search ..... 345/87, 345/98, 99, 204; 382/232, 236, 237
See application file for complete search history.

(56) References Cited

U.S. PATENT DOCUMENTS 5,345,268 A * 9/1994 Matsuta et al. ..... 348/384.1
5,841,475 A * 11/1998 Kurihara et al. ..... 375/240.15
5,909,513 A * 6/1999 Liang et al. ..... 382/253
5,953,488 A * 9/1999 Seto ..... 386/109
6,091,389 A * 7/2000 Maeda et al. ..... 345/98
6,756,955 B2 * 6/2004 Someya et al. ..... 345/88
6,943,763 B2 * 9/2005 Shibata et al. ..... 345/89
7,034,788 B2 * 4/2006 Someya et al. ..... 345/89
7,327,340 B2 * 2/2008 Someya et al. ..... 345/89
2002/0024481 A1 * 2/2002 Kawabe et al. ..... 345/87
2002/0033813 A1 * 3/2002 Matsumura et al. ..... 345/204
2002/0050965 A1 * 5/2002 Oda et al. ..... 345/87
2002/0126080 A1 * 9/2002 Willis et al. ..... 345/89
2002/0140652 A1 * 10/2002 Suzuki et al. ..... 345/87
2003/0080983 A1 * 5/2003 Someya et al. ..... 345/690
2003/0231158 A1 * 12/2003 Someya et al. ..... 345/101
2004/0160617 A1 * 8/2004 Okuda et al. ..... 358/1.9

(Continued)

FOREIGN PATENT DOCUMENTS

JP 09-081083 A 3/1997

(Continued)

*Primary Examiner*—Alexander Eisen
*Assistant Examiner*—Rodney Amadiz
(74) *Attorney, Agent, or Firm*—Birch, Stewart, Kolasch & Birch, LLP

(57) ABSTRACT

Consecutive frames of image data are processed for display by, for example, a liquid crystal display. The image data are compressed, delayed, and decompressed to generate primary reconstructed data representing the preceding frame, and the amount of change from the preceding frame to the current frame is determined. Secondary reconstructed data are generated from the current frame image data according to the amount of change. Compensated image data are generated from the current frame image data and the primary and secondary reconstructed data; in this process, either the primary or the secondary reconstructed data may be selected according to the amount of change, or the primary and secondary reconstructed data may be combined according to the amount of change. The amount of memory needed to delay the image data can thereby be reduced without introducing compression artifacts when the amount of change is small.

20 Claims, 21 Drawing Sheets

U.S. PATENT DOCUMENTS

2004/0217930 A1* 11/2004 Someya et al. ..... 345/87
2008/0019598 A1* 1/2008 Someya et al. ..... 382/236

FOREIGN PATENT DOCUMENTS

JP 2616652 B2 3/1997
JP 3041951 B2 3/2000
JP 2002-202763 A 7/2002
JP 3470095 B2 9/2003

* cited by examiner

FIG.3A

Di0

| | A | B | C | D |
|---|---|---|---|---|
| a | 52 | 152 | 52 | 52 |
| b | 52 | 152 | 52 | 52 |
| c | 48 | 148 | 48 | 48 |
| d | 48 | 148 | 48 | 48 |

FIG.3B

Da0

La=100 Lb=100

| | | | |
|---|---|---|---|
| 0 | 1 | 0 | 0 |
| 0 | 1 | 0 | 0 |
| 0 | 1 | 0 | 0 |
| 0 | 1 | 0 | 0 |

FIG.3C

Db0

| | A | B | C | D |
|---|---|---|---|---|
| a | 50 | 150 | 50 | 50 |
| b | 50 | 150 | 50 | 50 |
| c | 50 | 150 | 50 | 50 |
| d | 50 | 150 | 50 | 50 |

FIG.3G

Dv1

| | A | B | C | D |
|---|---|---|---|---|
| a | 0 | 0 | 0 | 0 |
| b | 0 | 0 | 0 | 0 |
| c | 0 | 0 | 0 | 0 |
| d | 0 | 0 | 0 | 0 |

FIG.3D

Di1

| | A | B | C | D |
|---|---|---|---|---|
| a | 52 | 152 | 52 | 52 |
| b | 52 | 152 | 52 | 52 |
| c | 48 | 148 | 48 | 48 |
| d | 48 | 148 | 48 | 48 |

FIG.3E

Da1

La=100 Lb=100

| | | | |
|---|---|---|---|
| 0 | 1 | 0 | 0 |
| 0 | 1 | 0 | 0 |
| 0 | 1 | 0 | 0 |
| 0 | 1 | 0 | 0 |

FIG.3F

Db1

| | A | B | C | D |
|---|---|---|---|---|
| a | 50 | 150 | 50 | 50 |
| b | 50 | 150 | 50 | 50 |
| c | 50 | 150 | 50 | 50 |
| d | 50 | 150 | 50 | 50 |

FIG.3H

Dq0

| | A | B | C | D |
|---|---|---|---|---|
| a | 52 | 152 | 52 | 52 |
| b | 52 | 152 | 52 | 52 |
| c | 48 | 148 | 48 | 48 |
| d | 48 | 148 | 48 | 48 |

IMAGE DATA PROCESSING METHOD, AND IMAGE DATA PROCESSING CIRCUIT

BACKGROUND OF THE INVENTION

1. Field of the Invention

The present invention relates, in the driving of a liquid crystal display device, to a processing method and a processing circuit for compensating image data in order to improve the response speed of the liquid crystal; more particularly, the invention relates to a processing method and a processing circuit for compensating the voltage level of a signal for displaying an image in accordance with the response speed characteristic of the liquid crystal display device and the amount of change in the image data.

2. Description of the Related Art

Liquid crystal panels are thin and lightweight, and their molecular orientation can be altered, thus changing their optical transmittance to enable gray-scale display of images, by the application of a driving voltage, so they are extensively used in television receivers, computer monitors, display units for portable information terminals, and so on. However, the liquid crystals used in liquid crystal panels have the disadvantage of being unable to handle rapidly changing images, because the transmittance varies according to a cumulative response effect. One known solution to this problem is to improve the response speed of the liquid crystal by applying a driving voltage higher than the normal liquid crystal driving voltage when the gray level of the image data changes.

For example, a video signal input to a liquid crystal display device may be sampled by an analog-to-digital converter, using a clock having a certain frequency, and converted to image data in a digital format, the image data being input to a comparator as image data of the current frame, and also being delayed in an image memory by an interval corresponding to one frame, then input to the comparator as image data of the previous frame. The comparator compares the image data of the current frame with the image data of the previous frame, and outputs a brightness change signal representing the difference in brightness between the image data of the two frames, together with the image data of the current frame, to a driving circuit. If the brightness value of a pixel has increased in the brightness change signal, the driving circuit drives the picture element on the liquid crystal panel by supplying a driving voltage higher than the normal liquid crystal driving voltage; if the brightness value has decreased, the driving circuit supplies a driving voltage lower than the normal liquid crystal driving voltage. When there is a change in brightness between the image data of the current frame and the image data of the previous frame, the response speed of the liquid crystal display element can be improved by varying the liquid crystal driving voltage by more than the normal amount in this way (see, for example, document 1 below).

Because the improvement of liquid crystal response speed described above involves delaying the image data in order to detect brightness changes by comparing the image data of the current frame with the image data of the previous frame, the image memory needs to be large enough to store one frame of image data. The number of pixels displayed on liquid crystal panels is increasing, due especially to increased screen size and higher definition in recent years, and the amount of image data per frame is increasing accordingly, so a need has arisen to increase the size of the image memory used for the delay; this increase in the size of the image memory raises the cost of the display device.

One known method of restraining the increase in the size of the image memory is to reduce the image memory size by allocating one address in the image memory to a plurality of pixels. For example, the size of the image memory can be reduced by decimating the image data, excluding every other pixel horizontally and vertically, so that one address in the image memory is allocated to four pixels; when pixel data are read from the image memory, the same image data as for the stored pixel are read repeatedly for the data of the excluded pixels, (see, for example, document 2 below).

Document 1: Japanese Patent No. 2616652 (pages 3-5, FIG. 1)

Document 2: Japanese Patent No. 3041951 (pages 2-4, FIG. 2)

A problem is that when the image data stored in the frame memory are reduced by a simple rule such as removing every other pixel vertically and horizontally, as in document 2 above, amounts of temporal change in the image data reconstructed by replacing the eliminated pixel data with adjacent pixel data may not be calculated correctly, in which case, since the amount of change used in compensation of the image data is erroneous, the compensation of the image data is not performed correctly, and the effectiveness with which the response speed of the liquid crystal display device is improved is reduced.

The present invention addresses this problem, with the object of enabling amounts of change in the image data to be detected accurately while requiring only a small amount of image memory to delay the image data, thereby enabling image data compensation to be performed accurately.

SUMMARY OF THE INVENTION

To attain the above object, the present invention provides an image data processing method for determining a voltage applied to a liquid crystal in a liquid crystal display device based on image data representing a plurality of frame images successively displayed on the liquid crystal display device, comprising:

calculating an amount of change between reconstructed current frame image data representing an image of a current frame and primary reconstructed preceding frame image data representing an image of a preceding frame which precedes the current frame by one frame interval, the reconstructed current frame image data being obtained by encoding and decoding original current frame image data representing the image of the current frame, the primary reconstructed preceding frame image data being obtained by encoding, delaying by one frame interval, and then decoding the original current frame image data;

generating secondary reconstructed preceding frame image data representing the image of the preceding frame, based on the original current frame image data and said amount of change;

generating reconstructed preceding frame image data representing an image of the preceding frame, based on an absolute value of said amount of change, the primary reconstructed preceding frame image data, and the secondary reconstructed preceding frame image data; and generating compensated image data having compensated values representing the image of the current frame, based on the original current frame image data and the reconstructed preceding frame image data.

According to the present invention, the data are compressed before being delayed, so the size of the image memory forming the delay unit can be reduced, and changes in the image data-can be detected accurately.

Moreover, optimal processing is carried out both when there is considerable change in the image data, and when there is little or practically no change, so accurate compensation can be carried out regardless of the degree of change in the image.

BRIEF DESCRIPTION OF THE DRAWINGS

In the attached drawings:

FIGS. 3A to 3H are diagrams showing values of image data for explaining effects of encoding and decoding errors on the compensated image data, in particular the effects when the absolute value of the amount of change is small;

BEST MODE OF PRACTICING THE INVENTION

First Embodiment

Figure 1:
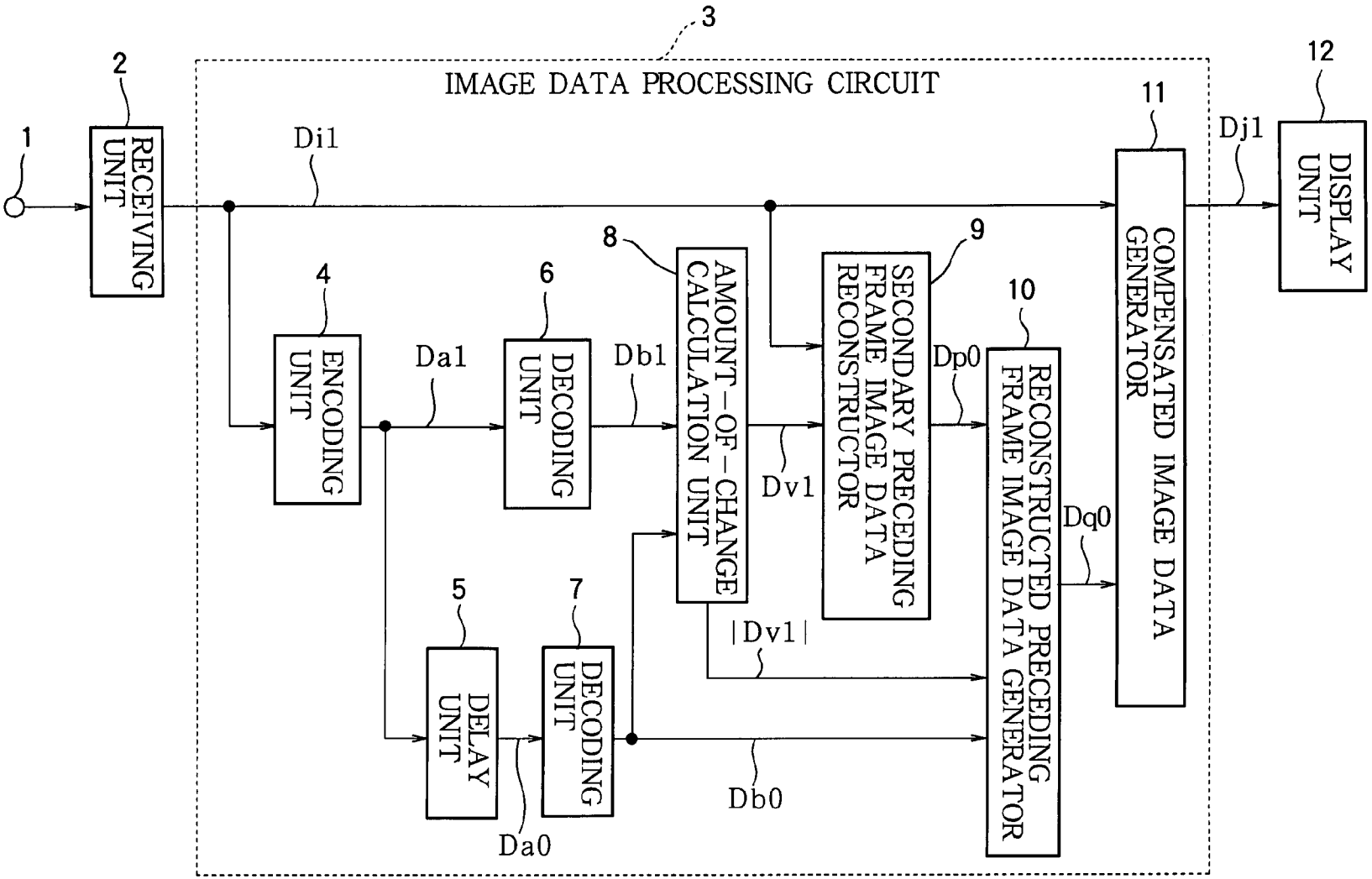
FIG. 1 is a block diagram showing the configuration of a liquid crystal display driving device according to a first embodiment of the present invention.

FIG. 1 is a block diagram showing the configuration of a liquid crystal display driving device according to a first embodiment of the present invention;

The input terminal 1 is a terminal through which an image signal is input to display an image on a liquid crystal display device. A receiving unit 2 performs tuning, demodulation, and other processing of the image signal received at the input terminal 1 and thereby successively outputs image data representing a one-frame portion of the present image, that is, the image data Di1 of the present frame (the current frame). The image data Di1 of the current frame, which have not undergone processing such as encoding in the processing circuit, will also be referred to as the original current frame image data.

The image data processing circuit 3 comprises an encoding unit 4, a delay unit 5, decoding units 6 and 7, an amount-of-change calculation unit 8, a secondary preceding frame image data reconstructor 9, a reconstructed preceding frame image data generator 10, and a compensated image data generator 11. The image data processing circuit 3 generates compensated image data Dj1 for the current frame, corresponding to the original current frame image data Di1. The compensated current frame image data Dj1 will also be referred to simply as compensated image data.

The display unit 12, which comprises an ordinary liquid crystal display panel, performs display operations by applying a signal voltage corresponding to the image data, such as a brightness signal voltage, to the liquid crystal to display an image.

The encoding unit 4 encodes the original current frame image data Di1 and outputs encoded image data Da1. The encoding involves data compression, and can reduce the amount of data in the image data Di1. Block truncation coding methods such as FBTC (fixed block truncation encoding) or GBTC (generalized block truncation encoding) can be used to encode the image data Di1. Any still-picture encoding method can also be used, including orthogonal transform encoding methods such as JPEG, predictive encoding methods such as JPEG-LS, and wavelet transform methods such as JPEG2000. These sorts of still-image encoding methods can be used even though they are non-reversible encoding methods in which the decoded image data do not perfectly match the image data before encoding.

The delay unit 5 receives the encoded image data Da1, delays the received data for an interval equivalent to one frame, and outputs the delayed data. The output of the delay unit 5 is previous frame image data Da0 in which are encoded the image data one frame before the current frame image data Di1, i.e., the previous frame image data (preceding frame image data).

The delay unit 5 comprises a memory that stores the encoded image data Da1 for one frame interval; the higher the encoding ratio (data compression ratio) of the image data is, the more the size of the memory can be reduced.

Decoding unit 6 decodes the encoded image data Da1 and outputs decoded image data Db1 corresponding to the current frame image. The decoded image data Db1 will also be referred to as reconstructed current frame image data.

Decoding unit 7 outputs decoded image data Db0 corresponding to the image of the preceding frame by decoding the encoded image data Da0 delayed by the delay unit 5. The decoded image data Db0 will also be referred to as primary reconstructed preceding frame image data, for a reason that will be explained later. The encoding unit 4, the delay unit 5 and the decoding unit 7 in combination form a primary preceding frame image data reconstructor.

The output of decoded image data Db1 by decoding unit 6 is substantially simultaneous with the output of decoded image data Db0 by decoding unit 7.

The amount-of-change calculation unit 8 subtracts the decoded image data Db1 corresponding to the image of the current frame from the decoded image data Db0 corresponding to the image of the preceding frame to obtain their difference, obtaining an amount of change Av1 and its absolute value |Av1|. More specifically, it calculates and outputs amount-of-change data Dv1 and absolute amount-of-change data |Dv1| representing the amount of change and its absolute value. The amount of change Av1 will also be referred to as the first amount of change, to distinguish it from a second amount of change Dw1 that will be described later. For the same reason, the amount-of-change data Dv1 and absolute amount-of-change data |Dv1| will also be referred to as the first amount-of-change data and first absolute amount-of-change data.

The amount-of-change calculation unit 8, in combination with the decoding unit 6, forms an amount-of-change calculation circuit which calculates an amount of change between the image of the current frame and the image of the preceding frame.

The secondary preceding frame image data reconstructor 9 calculates secondary reconstructed preceding frame image data Dp0 corresponding to the image in the preceding frame by adding the amount-of-change data Dv1 to the current frame image data Di1 (in effect, adding the amount of change Av1 to the value of the original current frame image data Di1). The output of decoding unit 7 is referred to as the primary reconstructed preceding frame image data to distinguish it from the secondary reconstructed preceding frame image data output from the secondary preceding frame image data reconstructor 9. The encoding unit 4, the delay unit 5 and the decoding unit 7 in combination form a reconstructed preceding frame image data generator.

The reconstructed preceding frame image data generator 10 generates reconstructed preceding frame image data Dq0 based on the absolute amount-of-change data |Dv1| output by the amount-of-change calculation unit 8, the primary reconstructed preceding frame image data Db0 from decoding unit 7, and the secondary reconstructed preceding frame image data Dp0 from the secondary preceding frame image data reconstructor 9, and outputs the reconstructed preceding frame image data Dq0 to the compensated image data generator 11.

For example, either the primary reconstructed preceding frame image data Db0 or the secondary reconstructed preceding frame image data Dp0 may be selected and output, based on the absolute amount of change data |Dv1|. More specifically, the primary reconstructed preceding frame image data Db0 is selected and output as the reconstructed preceding frame image data Dq0 when the absolute amount-of-change data |Dv1| is greater than a threshold SH0, which may be set arbitrarily, and the secondary reconstructed preceding frame image data Dp0 is selected and output as the reconstructed preceding frame image data Dq0 when the absolute amount of change data |Dv1| is less than the threshold SH0.

The compensated image data generator 11 generates and outputs compensated image data Dj1 based on the original current frame image data Di1 and the reconstructed preceding frame image data Dq0.

The compensation is performed to compensate for the delay due to the response speed characteristic of the liquid crystal display device; when the brightness value of an image changes between the current frame and the preceding frame, for example, the voltage levels of the signal that determines the brightness values of the image corresponding to the current frame image data Di1 are compensated so that the liquid crystal will achieve the transmittance corresponding to the brightness values of the current frame image before the elapse of one frame interval from the display of the preceding frame image.

The compensated image data generator 11 compensates the voltage levels of the signal for displaying the image corresponding to the image data of the current frame in correspondence to the response speed characteristic indicating the time from the input of image data to the display unit 12 of the liquid crystal display device to the display thereof and the amount of change between the image data of the preceding frame and the image data of the current frame input to the liquid crystal display driving device.

Figure 2A:
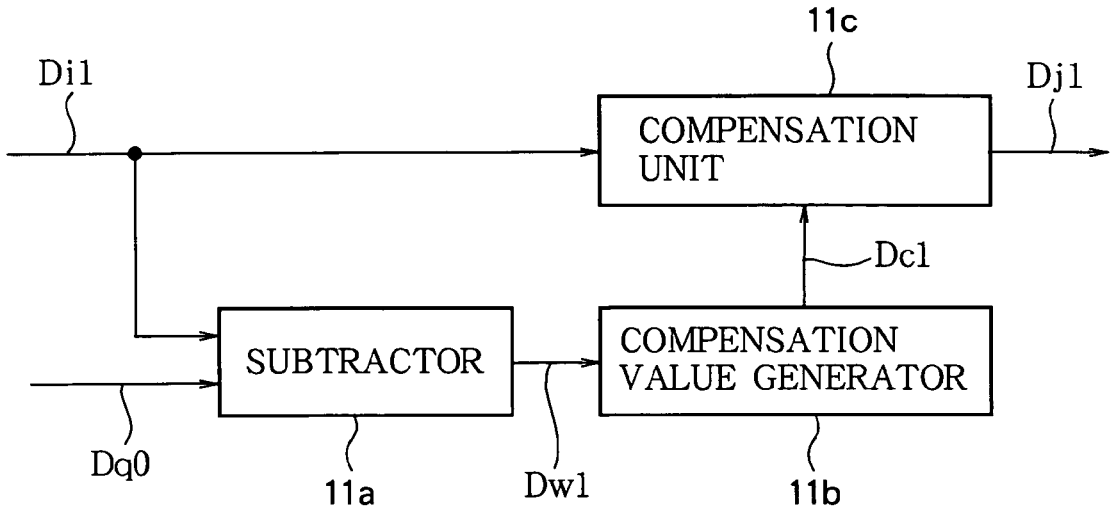
FIGS. 2A and 2B are block diagrams showing examples of the compensated image data generator in FIG. 1 in more detail.
Figure 2B:
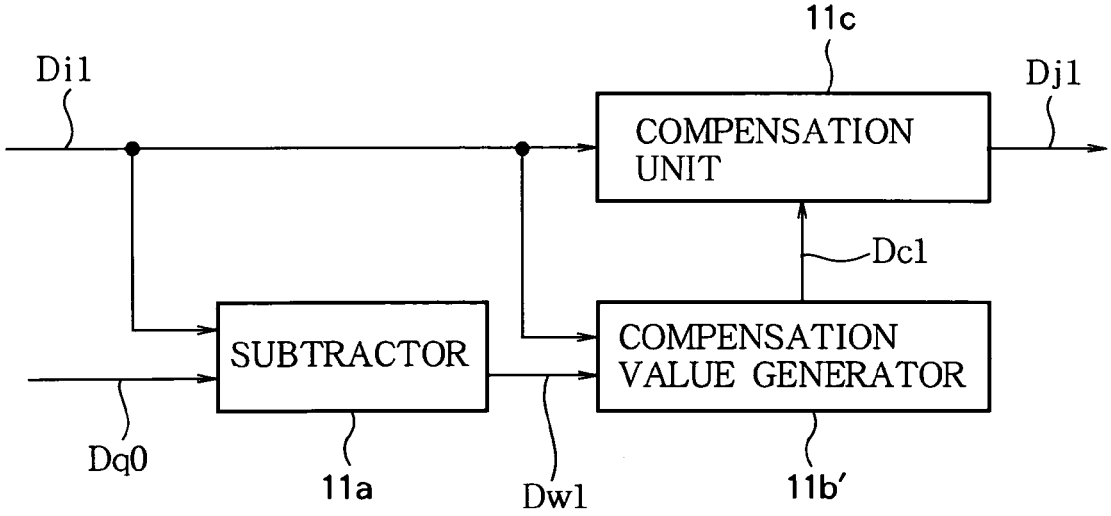

FIGS. 2A and 2B are block diagrams showing examples of the compensated image data generator 11 in more detail. The compensated image data generator 11 in FIG. 2A has a subtractor 11*a*, a compensation value generator 11*b*, and a compensation unit 11*c*.

The subtractor 11*a* calculates the difference between the reconstructed preceding frame image data Dq0 and the original current frame image data Di1; that is, it calculates the second amount of change Dw1. The reconstructed preceding frame image data Dq0 is either the primary reconstructed preceding frame image data Db0 or the secondary reconstructed preceding frame image data Dp0, selected according to the value of the absolute amount-of-change data |Dv1|.

The compensation value generator 11*b* calculates a compensation value Dc1 from the response time of the liquid crystal corresponding to the second amount of change Dw1, and outputs the compensation value Dc1.

Dc1=Dw1*a can be used as an exemplary formula showing the operation of the compensation value generator 11*b*. The quantity a, which is determined from the characteristics of the liquid crystal used in the display unit 12, is a weighting coefficient for determining the compensation value Dc1.

The compensation value generator 11*b* determines the compensation value Dc1 by multiplying the amount of change Dw1 output from the subtractor 11*a* by the weighting coefficient a.

The compensation value Dc1 can also be calculated by use of the formula Dc1=Dw1*a (Di1) by changing the compensation value generator 11*b* to the compensation value generator 11*b*' configured as shown in FIG. 2B. Here, a (Di1) is a weighting coefficient for determining the compensation value Dc1, but the weighting coefficient is generated on the basis of the original current frame image data Di1. This function is determined according to the characteristics of the liquid crystal; the function may, for example, strengthen the weights of high-brightness parts, or strengthen the weights of medium-brightness parts; a quadratic function or a function of higher degree may be used.

The compensation unit 11*c* uses the compensation data Dc1 to compensate the original current frame image data Di1, and outputs the compensated image data Dj1. The compensation unit 11*c* generates the compensated image data Dj1 by, for example, adding the compensation value Dc1 to the original current frame image data Di1.

Instead of this type of compensation unit, one that generates the compensated image data Dj1 by multiplying the original current frame image data Di1 by the compensation value Dc1 may be used.

The display unit 12 uses a liquid crystal panel and applies a voltage corresponding to the compensated image data Dj1 to the liquid crystal to change its transmittance, thereby changing the displayed brightness of the pixels, whereby the image is displayed.

The difference between the effect when the primary reconstructed preceding frame image data Db0 output from decoding unit 7 are used as the reconstructed preceding frame image data Dq0 and the effect when the secondary reconstructed preceding frame image data Dp0 output from the secondary preceding frame image data reconstructor 9 are used as the reconstructed preceding frame image data Dq0 will now be described.

First, suppose that the reconstructed preceding frame image data generator 10 always outputs the primary reconstructed preceding frame image data Db0 as the reconstructed preceding frame image data Dq0, regardless of the amount of change Av1. In this case, the compensated image data generator 11 always generates the compensated image data Dj1 from the original current frame image data Di1 and the decoded image data Db0.

Among a series of images input successively from the input terminal 1, if there is a difference of a certain value or more between the images of preceding and following frames, that is, if there is a large temporal change, the compensated image data generator 11 performs compensation responsive to the temporal changes in the image data, but the decoded image data Db0 include encoding and decoding error due to the encoding unit 4 and the decoding unit 7, so this error will be included in the compensated image data Dj1 as compensation error. This encoding and decoding error can be tolerated when there are comparatively large changes in the image. That is, when there are large changes in the image, there is no great problem in using the decoded image data, i.e., the primary reconstructed preceding frame image data Db0, as the reconstructed preceding frame image data Dq0.

If there is no large difference between the images of preceding and following frames, that is, if there is little or no temporal change, it would be desirable for the compensated image data generator 11 to output the original current frame image data Di1 as the compensated image data Dj1 without compensating the image data. Since the decoded image data Db0 include encoding and decoding error as explained above, however, even when the image does not change, the decoded image data Db0 may not match the original current frame image data Di1. The result is that the compensated image data generator 11 adds unnecessary compensation to the original current frame image data Di1. If the image does not change, since the error of this compensation is added as noise to the current frame image, the error cannot be ignored. When the image does not change, that is, it is not appropriate to use the decoded image data, i.e., the primary reconstructed preceding frame image data Db0, as the reconstructed preceding frame image data Dq0.

Next, suppose that the reconstructed preceding frame image data generator 10 always outputs the secondary reconstructed preceding frame image data Dp0 as the reconstructed preceding frame image data Dq0, regardless of the amount of change Av1.

Since the secondary reconstructed preceding frame image data Dp0 are calculated from the original current frame image data Di1 and the amount-of-change data Dv1, the encoding and decoding error of the decoded image data Db1 corresponding to the current frame image, that is, the encoding and decoding error due to the encoding unit 4 and decoding unit 6, and the encoding and decoding error of the decoded image data Db0 corresponding to the preceding frame image, that is, the encoding and decoding error due to the encoding unit 4 and decoding unit 7, are included in a combined form (mutually reinforcing or canceling) in the secondary reconstructed preceding frame image data Dp0.

When there is a comparatively large temporal change in the image data input from the input terminal 1, the above combined error may be larger or smaller than the above-described the encoding and decoding error of the decoded image data Db0 alone, i.e., the encoding and decoding error due to the encoding unit 4 and decoding unit 7, but in general the error tends to be larger. When there is thus a comparatively large temporal change in the image, encoding and decoding error of the decoded image data Db0 and decoded image data Db1 is included in the secondary reconstructed preceding frame image data Dp0, and accordingly in the compensated image data Dj1; this error tends to be larger than the encoding and decoding error of the decoded image data Db0 alone, so when there is a large change in the image, it is inappropriate to use the secondary reconstructed preceding frame image data Dp0 as the reconstructed preceding frame image data Dq0.

When the input image data do not change, both the decoded image data Db1 corresponding to the current frame image and the decoded image data Db0 corresponding to the preceding frame image contain coding or decoding error, but the encoding and decoding errors included in these two decoded image data are the same. If the image does not change at all, accordingly, the errors in the two reconstructed preceding frame image data Db0 and Db1 completely cancel out; the amount-of change data Dv1 are zero, as if encoding and decoding had not been performed, and the secondary reconstructed preceding frame image data Dp0 are identical to the original current frame image data Di1. In the reconstructed preceding frame image data generator 10, the secondary reconstructed preceding frame image data Dp0 are output as the reconstructed preceding frame image data Dq0 to the compensated image data generator 11, and in the compensated image data generator 11, as described above, no unnecessary compensation is performed, as would be performed if the primary reconstructed preceding frame image data Db0 were always output. Accordingly, when the image does not change, it is appropriate to use the secondary reconstructed preceding frame image data Dp0 as the reconstructed preceding frame image data Dq0.

From the above, it can be seen that the encoding and decoding error included in the compensated image data Dj1 output from the compensated image data generator 11 can be reduced in the reconstructed preceding frame image data generator 10 by selecting the secondary reconstructed preceding frame image data Dp0, which is advantageous when the image does not change, in the reconstructed preceding frame image data generator 10 if the absolute amount-of-change data |Dv1| is less than a threshold SH0, and selecting the primary reconstructed preceding frame image data Db0, which is advantageous when the image changes greatly, if the absolute amount-of-change data |Dv1| is greater than the threshold SH0.

The encoding unit 4 and decoding units 6 and 7 of the first embodiment are not configured for reversible encoding. If the encoding unit 4 and decoding units 6 and 7 were to be configured for reversible encoding, the above-described effects of encoding and decoding error would vanish, making the decoding unit 6, the amount-of-change calculation unit 8, the secondary preceding frame image data reconstructor 9, and the reconstructed preceding frame image data generator 10 unnecessary. In that case, decoding unit 7 could always input reconstructed preceding frame image data Db0 to the compensated image data generator 11 as the reconstructed preceding frame image data Dq0, simplifying the circuit. The present embodiment applies to a non-reversible encoding unit 4 and decoding units 6 and 7, rather than to units of the reversible coding type.

Error due to encoding and decoding will be described below with reference to FIGS. 3A to 3H.

FIGS. 3A to 3H show an example of the effect of encoding and decoding error on the compensated image data Dj1, especially the effect when the absolute amount-of-change data |Dv1| is small (smaller than the threshold SH0). The letters A to D in FIGS. 3A, 3C, 3D, 3F, 3G, and 3H designate columns to which pixels belong; the letters a to d designate rows to which pixels belong.

FIG. 3A shows exemplary values of the original preceding frame image data Di0, that is, the image data representing the image one frame before the current frame. FIG. 3B shows exemplary encoded image data Da0 obtained by coding the preceding frame image data Di0 shown in FIG. 3A. FIG. 3C shows exemplary reconstructed preceding frame image data Db0 obtained by decoding the encoded image data Da0 shown in FIG. 3B.

FIG. 3D shows exemplary values of the original current frame image data Di1. FIG. 3E shows exemplary encoded image data Da1 obtained by coding the original current frame image data Di1 shown in FIG. 3D. FIG. 3F shows exemplary current frame decoded image data Db1 obtained by decoding the encoded image data Da1 shown in FIG. 3E.

FIG. 3G shows exemplary values of the amount-of-change data Dv1 obtained by taking the difference between the decoded image data Db0 shown in FIG. 3C and the decoded image data Db1 shown in FIG. 3F. FIG. 3H shows exemplary values of the reconstructed preceding frame image data Dq0 output from the reconstructed preceding frame image data generator 10 to the compensated image data generator 11.

The values of the current frame image data Di1 shown in FIG. 3D are unchanged from the values of the preceding frame image data Di0 shown in FIG. 3A. FIGS. 3B and 3E show encoded image data obtained by FTBC encoding, using eight-bit representative values La, Lb, with one bit being assigned to each pixel.

As can be seen from comparisons of the image data before encoding, shown in FIGS. 3A and 3D, with the image data that have been encoded and decoded, shown in FIGS. 3C and 3F, the values of the decoded image data shown in FIGS. 3C and 3F contain errors. As can be seen from FIGS. 3C and 3F, the data Db0 and Db1 that have been encoded and decoded are mutually equal. Thus even when encoding and decoding error arises in the decoded image data Db1 and Db0, since the decoded image data Db1 and the decoded image data Db0 are mutually equal, the values (FIG. 3G) of the differences between them are zero.

In the present embodiment, the secondary reconstructed preceding frame image data Dp0 are the sum of the values of the original current image data Di1 in FIG. 3D and the amount-of-change data Dv1 in FIG. 3G, but since the values of the amount-of-change data Dv1 in FIG. 3G are zero, the values of the secondary reconstructed preceding frame image data Dp0 are the same as the values of the original current frame image data Di1. Accordingly, the values of the preceding frame image data Dq0 shown in FIG. 3H, output from the reconstructed preceding frame image data generator 10, are the same as the values of the original current frame image data Di1 in FIG. 3D; these values are output to the compensated image data generator 11.

The original current frame image data Di1 input to the compensated image data generator 11 have not undergone an image encoding process in the encoding unit 4. The compensated image data generator 11, to which the unchanging data in FIGS. 3D and 3H are input, receives the original current frame image data Di1 and the reconstructed preceding frame image data Dq0, which have the same values, and can output the compensated image data Dj1 to the display unit 12, without compensating the original current frame image data Di1 (in other words, it outputs data obtained by compensation with compensating values of zero), as is desirable when the image does not change.

Figure 4:
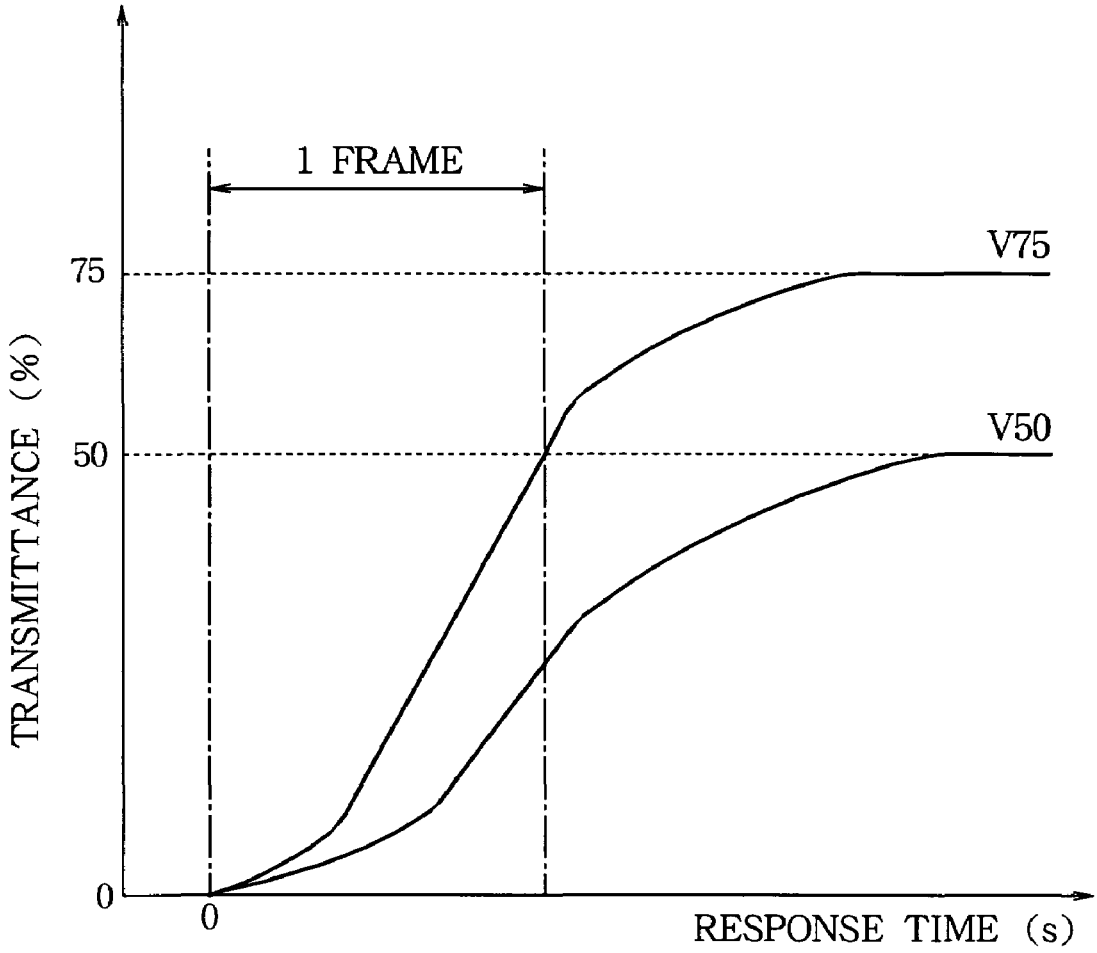
FIG. 4 is a diagram showing examples of the response characteristics of a liquid crystal.

FIG. 4 shows an example of the response speed of a liquid crystal, showing changes in transmittance when voltages V50 and V75 are applied in the 0% transmittance state. FIG. 4 shows that there are cases in which an interval longer than one frame interval is needed for the liquid crystal to reach the proper transmittance value. When the brightness value of the image data changes, the response speed of the liquid crystal can be improved by applying a larger voltage, so that the transmittance reaches the desired value within one frame interval.

If voltage V75 is applied, for example, the transmittance of the liquid crystal reaches 50% when one frame interval has elapsed. Therefore, if the target value of the transmittance is 50%, the transmittance of the liquid crystal can reach the desired value within one frame interval if the voltage applied to the liquid crystal is V75. Thus when the image data Di1 changes from 0 to 127, the transmittance can be brought to the desired value within one frame interval by inputting 191 as compensated image data as Dj1 to the display unit 12.

Figure 5A:
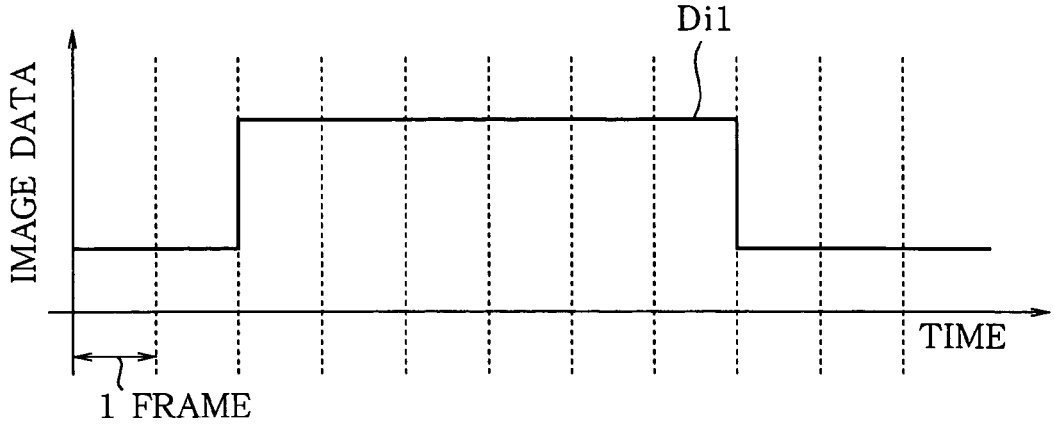
FIG. 5A is a diagram showing variations in a current frame image data value.
Figure 5B:
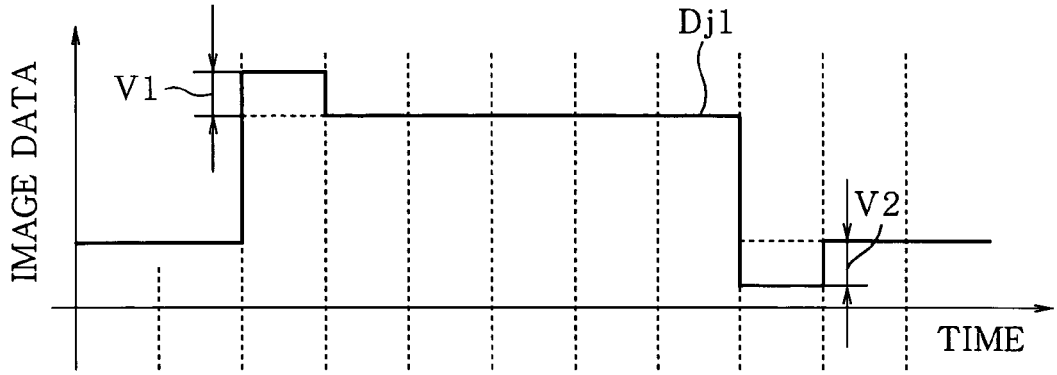
FIG. 5B is a diagram showing variations in the compensated image data value obtained by compensation with compensation data.
Figure 5C:
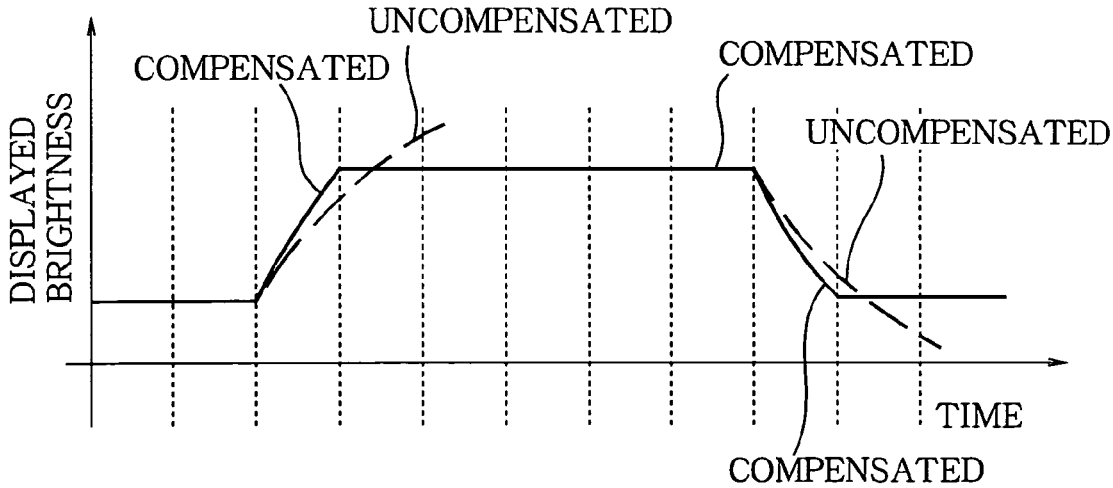
FIG. 5C is a diagram showing the response characteristic of the liquid crystal responsive to an applied voltage corresponding to the compensated image data.

FIGS. 5A to 5C illustrate the operation of the liquid crystal driving circuit of the present embodiment. FIG. 5A illustrates changes in the values of the current frame image data Di1. FIG. 5B illustrates changes in the values of the compensated image data Dj1 obtained by compensation with the compensation data Dc1. FIG. 5C shows the response characteristic (solid curve) of the liquid crystal when a voltage corresponding to the compensated image data Dj1 is applied. FIG. 5C also shows the response characteristic (dashed curve) of the liquid crystal when the uncompensated image data (the current frame image data) Di1 are applied. When the brightness value increases or decreases as shown in FIG. 5B, a compensation value V1 or V2 is added to or subtracted from the original current frame image data Di1 according to the compensation data Dc1 to generate the compensated image data Dj1. A voltage corresponding to the compensated image data Dj1 is applied to the liquid crystal in the display unit 12, thereby driving the liquid crystal to the predetermined transmittance value within substantially one frame interval (FIG. 5C).

Figure 6A:
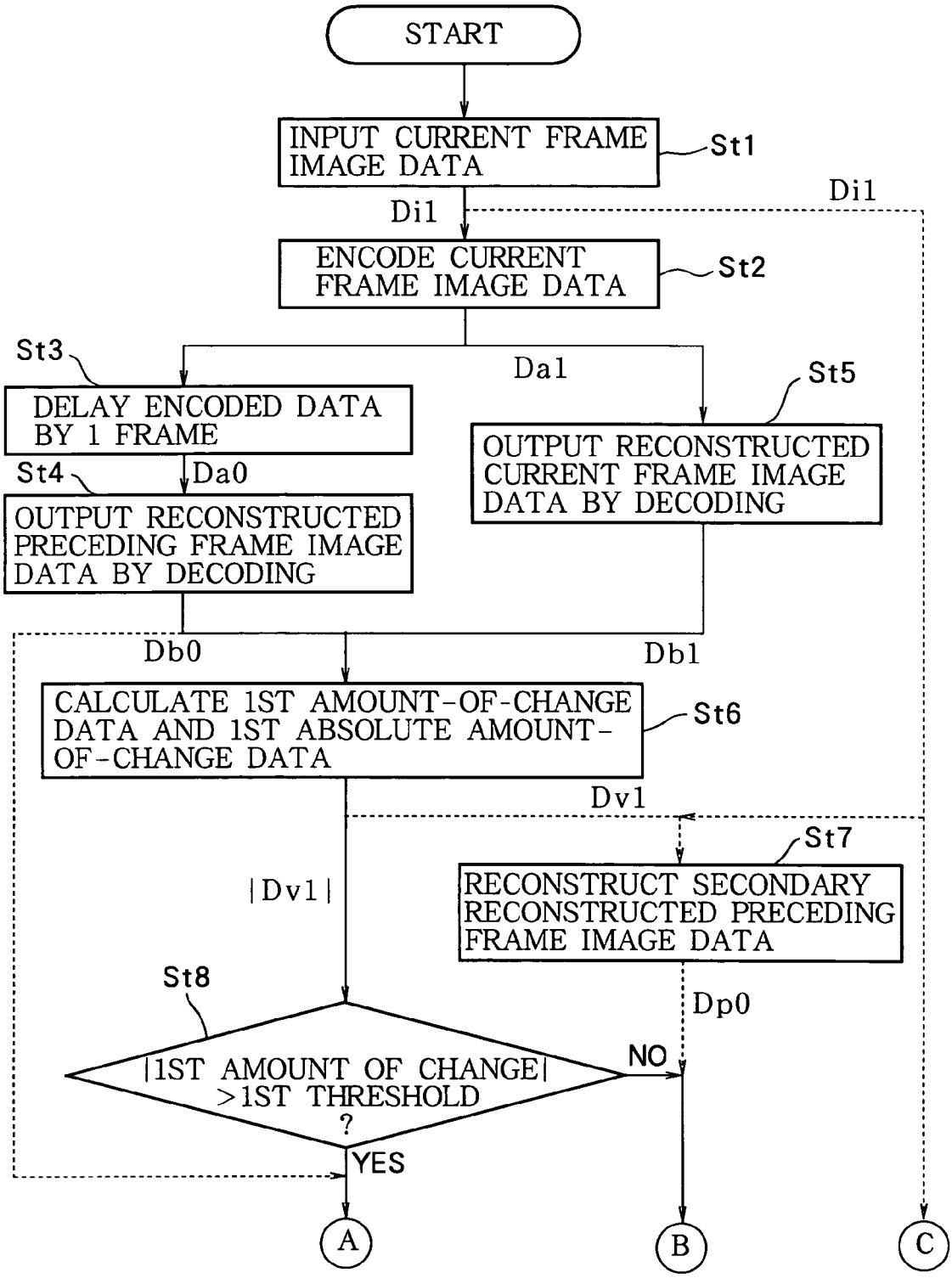
FIGS. 6A and 6B constitute a flowchart schematically showing an example of the image data processing method of the image data processing circuit shown in FIG. 1.
Figure 6B:
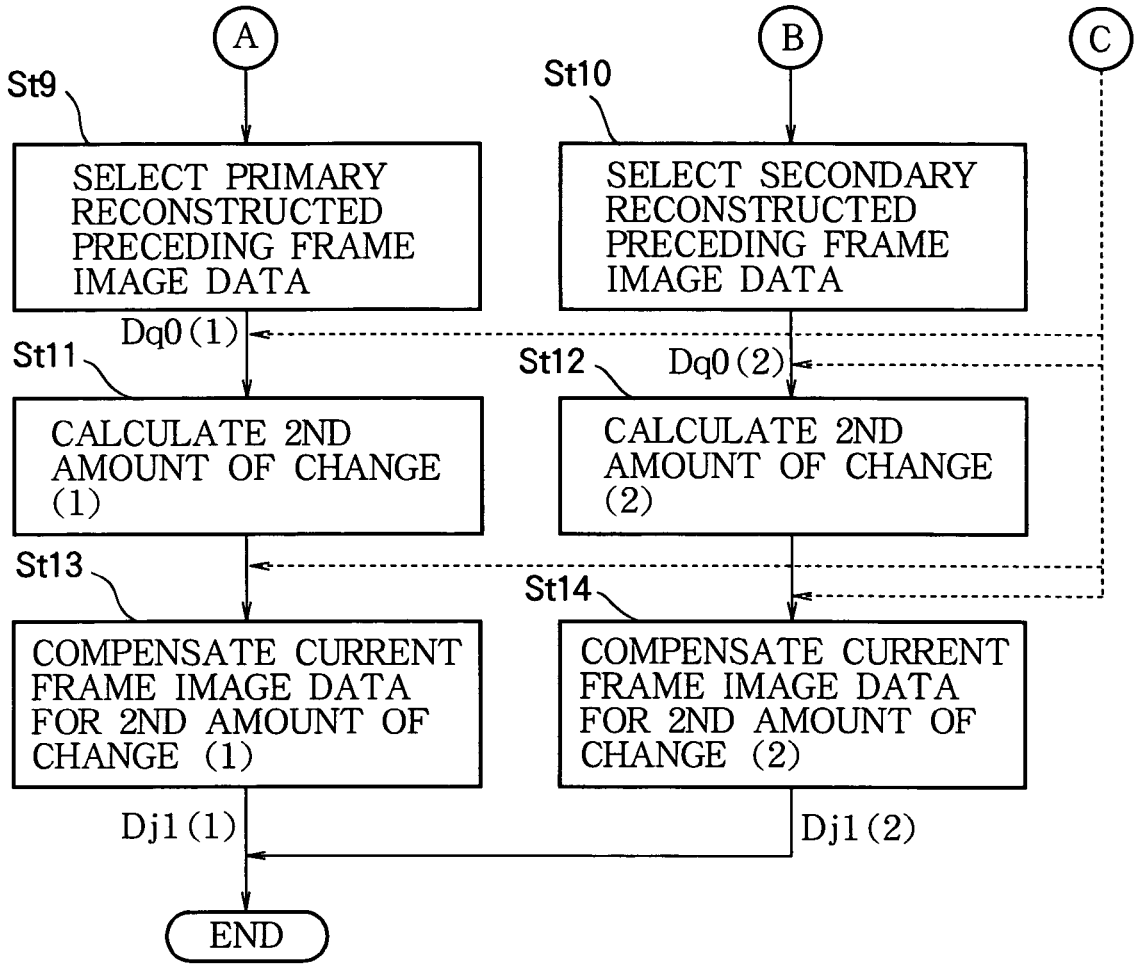

FIGS. 6A and 6B are a flowchart schematically showing an example of the image data processing method of the image data processing circuit shown in FIG. 1.

First, when the current frame image data Di1 is input from the input terminal 1 through the receiving unit 2 to the image data processing circuit 3 (St1), the encoding unit 4 compressively encodes the current frame image data Di1 and outputs the encoded image data Da1, the data size of which has been reduced (St2). The encoded image data Da1 are input to the delay unit 5, which outputs the encoded image data Da1 with a delay of one frame. The output of the delay unit 5 is the encoded image data Da0 of the preceding frame (St3). The encoded image data Da0 are input to the decoding unit 7, which outputs the preceding frame decoded image data Db0 by decoding the input encoded image data Da0 (St4).

The encoded image data Da1 output from the encoding unit 4 are also input to the decoding unit 6, which outputs decoded image data of the current frame, that is, the reconstructed current frame image data Db1, by decoding the input encoded image data Da1 (St5) The preceding frame decoded image data Db0 and the current frame decoded image data Db1 are input to the amount-of-change calculation unit 8, and the difference obtained by, for instance, subtracting the current frame decoded image data Db1 from the preceding frame decoded image data Db0 and the absolute value of the difference are output as amount-of-change data Dv1 and first absolute amount-of-change data |Dv1| expressing the amount of change Av1 of each pixel and its absolute value |Av1| (St6). The amount of change Dv1 accordingly indicates the temporal change Av1 of the image data for each pixel in the frame by using the decoded image data of two temporally differing frames, such as the preceding frame decoded image data Db0 and the current frame decoded image data Dbl.

The first amount-of-change data Dv1 is input to the secondary preceding frame image data reconstructor 9, which reconstructs and outputs the secondary reconstructed preceding frame image data Dp0 by adding the amount-of-change data Dv1 to the original current frame image data Di1, which are input separately (St7).

The absolute amount-of-change data |Dv1| are input to the reconstructed preceding frame image data generator 10, which decides whether the first absolute amount-of-change data |Dv1| are greater than a first threshold (St8). If the absolute amount-of-change data |Dv1| are greater than the first threshold (St8: YES), the reconstructed preceding frame image data generator 10 selects the primary reconstructed preceding frame image data Db0, which are input separately, rather than the secondary reconstructed preceding frame image data Dp0 and outputs the reconstructed preceding frame image data Db0 to the compensated image data generator 11 as the reconstructed preceding frame image data Dq0 (St9). When the absolute amount-of-change data |Dv1| are not greater than the first threshold (St8: NO), the reconstructed preceding frame image data generator 10 selects the secondary reconstructed preceding frame image data Dp0 rather than the primary reconstructed preceding frame image data Db0 and outputs the secondary reconstructed preceding frame image data Dp0 to the compensated image data generator 11 as the preceding frame image data Dq0 (St10).

When the primary reconstructed preceding frame image data Db0 are input to the compensated image data generator 11 as the reconstructed preceding frame image data Dq0, the subtractor 11*a* generates the difference between the primary reconstructed preceding frame image data Db0 and the original current frame image data Di1, that is, the second amount of change Dw1 (1) (St11), the compensation value generator 11*b* calculates compensation values Dc1 from the response time of the liquid crystal corresponding to the second amount of change Dw1 (1), and the compensation unit 11*c* generates and outputs the compensated image data Dj1 (1) by using the compensation values Dc1 to compensate the original current frame image data Di1 (St13).

When the secondary reconstructed preceding frame image data Dp0 are input to the compensated image data generator 11 as the reconstructed preceding frame image data Dq0, the subtractor 11*a* generates the difference between the secondary reconstructed preceding frame image data Dp0 and the original current frame image data Di1, that is, the second amount of change Dw1 (2) (St12), the compensation value generator lib calculates compensation values Dc1 from the response time of the liquid crystal corresponding to the second amount of change Dw1 (2), and the compensation unit 11*c* generates and outputs the compensated image data Dj1 (2) by using the compensation values Dc1 to compensate the original current frame image data Di1 (St14).

The compensation in steps St13 and St14 compensates the voltage level of a brightness signal or other display signal corresponding to the image data of the current frame in accordance with the response speed characteristic representing the time from input of image data to the liquid crystal display device in the display unit 12 until display of the image, and the amount of change from the preceding frame to the current frame in the image data input to the liquid crystal display driving device.

When the first amount of change Av1 is zero, the second amount of change is also zero and the compensation value Dc1 is zero, so the original current frame image data Di1 are not compensated but are output without alteration as the compensated image data Dj1.

The display unit 12 displays the compensated image data Dj1 by, for example, applying a voltage corresponding to a brightness value expressed thereby to the liquid crystal.

Figure 7:
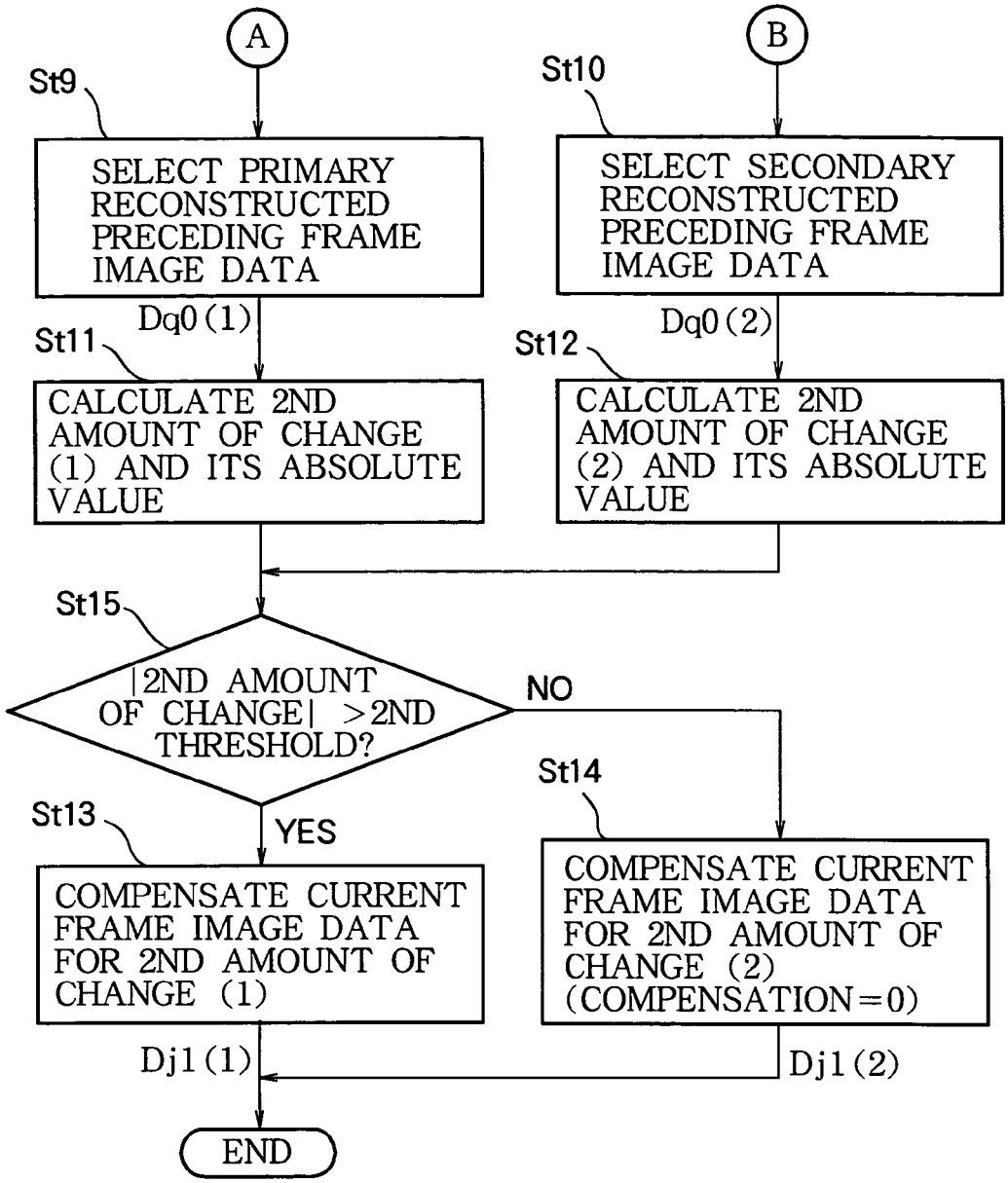
FIG. 7 is a flowchart schematically showing another example of the image data processing method of the image data processing circuit shown in FIG. 1.

FIG. 7 is a flowchart schematically showing another example of the image data processing method in the compensated image data generator 11 in FIG. 1. The process through steps St11 and St12 in FIG. 7 is the same as in the example shown in FIGS. 6A and 6B; steps St1 to St8 are omitted from the drawing.

Steps St9, St10, St11, and St12 in FIG. 7 are the same as in FIG. 6B. In steps St11 and St12, however, in addition to the second amount of change Dw1, its absolute value |Dw1| is also generated.

Upon receiving input of the second amount of change Dw1 (1) and its absolute value from step St11 or the second amount of change Dw1 (2) and its absolute value from step St12 in FIG. 7, the compensated image data generator 11 decides whether the absolute value of the second amount of change Dw1 is greater than a second threshold or not (St15); if the absolute value of the second amount of change Dw1 is greater than the second threshold (St15: YES), it generates and outputs compensated image data Dj1 (1) by compensating the original current frame image data Di1 (St13).

If the absolute value of the second amount of change Dw1 is not greater than the second threshold (St15: NO), the compensated image data Dj1 (2) are generated and output by compensating the original current frame image data Di1 by a restricted amount, or the compensated image data Dj1 (2) are generated and output without performing any compensation, so that the amount of compensation is zero (St14).

The display unit 12 displays the compensated image data Dj1 by, for example, applying a voltage corresponding to a brightness value expressed thereby to the liquid crystal.

The above-described steps from St11 to St15 are carried out for each pixel and each frame.

In the description given above, the reconstructed preceding frame image data generator 10 selects either the secondary reconstructed preceding frame image data Dp0 or the reconstructed preceding frame image data Db0, in accordance with threshold SH0 which can be specified as desired, but the processing in the reconstructed preceding frame image data generator 10 is not limited to this.

For example, two values SH0 and SH1 may be provided as second thresholds, and the reconstructed preceding frame image data generator 10 may be configured to output the reconstructed preceding frame image data Dq0 as follows, according to the relationships among these thresholds SH0 and SH1 and the absolute amount-of-change data |Dv1|.

The relationship between SH0 and SH1 is given by the following expression (1):

$$SH1 > SH0 \tag{1}$$

When |Dv1|<SH0, $$Dq0 = Dp0 \tag{2}$$

$$\text{When } SH0 \le |Dv1| \le SH1, \tag{3}$$

$$Dq0 = Db0 \times (|Dv1| - SH0)/(SH1 - SH0) + Dp0 \times \{1 - (|Dv1| - SH0)/(SH1 - SH0)\}$$

When SH1<|Dv1|, $$Dq0 = Db0 \tag{4}$$

When the absolute amount-of-change data Dv1 are between the thresholds SH0 and SH1, the preceding frame image data Dq0 are calculated from the primary reconstructed preceding frame image data Db0 and the secondary reconstructed preceding frame image data Dp0 as in equations (2) to (4). That is, when the primary reconstructed preceding frame image data Db0 and the secondary reconstructed preceding frame image data Dp0 are combined in a ratio corresponding to the position of the absolute amount-of-change data |Dv1| in the range between threshold SH0 and threshold SH1 (calculated by adding their values multiplied by coefficients corresponding to closeness to the thresholds) and output as the reconstructed preceding frame image data Dq0. Accordingly, a step-like transition in the reconstructed preceding frame image data Dq0 can be avoided at the boundary between the range in which the amount of change is small and can be appropriately processed as if there were no change, and the range that is appropriately processed as if there was a large change in the image, and near this boundary, processing can be carried out as a compromise between the processing when there is no change and the processing when there is a large change.

When generating the compensated image data Dj1, the image data processing circuit of the present embodiment is adapted to use the secondary reconstructed preceding frame image data Dp0 output by the secondary preceding frame image data reconstructor 9 as the reconstructed preceding frame image data when the absolute value of the amount of change is small, and to use the primary reconstructed preceding frame image data Db0 output by decoding unit 7 as the reconstructed preceding frame image data Dq0 when the absolute value of the amount of change is large, so it is possible both to prevent the occurrence of error when the input image data do not change, and to reduce the error when the input image data change.

Since the original current frame image data Di1 are encoded by the encoding unit 4 so as to compress the amount of data and the compressed data are delayed, the amount of memory needed for delaying the original ddi1 by one frame interval can be reduced.

Since the original current frame image data Di1 are encoded and decoded without decimating the pixel information, compensated image data Dj1 with appropriate values can be generated and the response speed of the liquid crystal can be precisely controlled.

Since the image sensor generates the compensated image data Dj1 on the basis of the original current frame image data Di1 and the reconstructed preceding frame image data Dq0, the compensated image data Dj1 are not affected by encoding and decoding errors.

Second Embodiment

In the first embodiment, the compensated image data generator 11 calculates a second amount of change between the primary reconstructed preceding frame image data Db0 or the secondary reconstructed preceding frame image data Dp0 and the original current frame image data Di1, and then compensates the voltage-level of the brightness signal or other signal corresponding to the image data of the current frame in accordance with the response speed characteristic and the amount of change in the image data between the current frame and preceding frame, but calculating these image data for each pixel places an increased computational load on the processing unit, which is a problem. The load may be tolerable if the formulas for calculating the compensation data are simple, but if the formulas are complex, the computational load may be too great to handle. In the second embodiment, shown below, the compensation values and amounts to be applied to the image data of the current frame are pre-calculated from the response times of the liquid crystal corresponding to the image data values in the current frame and the preceding frame, and the compensation amounts thus obtained are stored in a lookup table; the amounts of compensation can then be found by use of this table, and the compensated image data are generated and output by use of these compensation amounts.

Aside from storing a table of compensation amounts in the compensated image data generator 11 and outputting compensation amounts obtained by use of the table, this embodiment is similar to the first embodiment described above, so redundant descriptions will be omitted.

Figure 8:
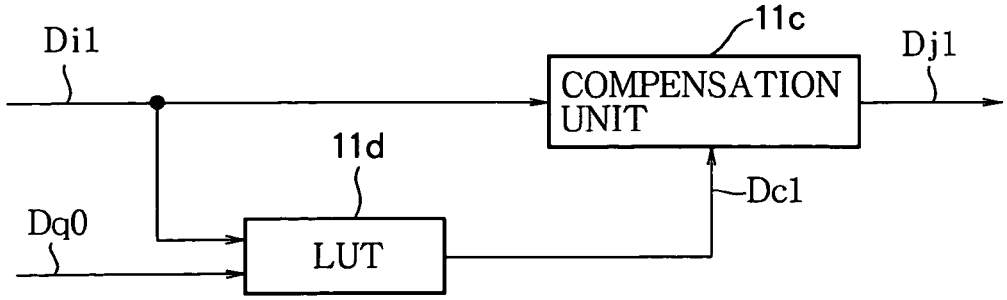
FIG. 8 is a block diagram showing an example of a compensated image data generator used in a second embodiment of the present invention.

FIG. 8 shows the details of an example of the compensated image data generator 11 used in the second embodiment. This compensated image data generator 11 has a compensation unit 11*c* and a lookup table (LUT) 11*d*.

As will be explained in more detail below, the lookup table 11*d* takes the reconstructed preceding frame image data Dq0 and current frame image data Di1 as inputs, and outputs data prestored at an address (memory location) specified thereby as a compensation value Dc1. The lookup table 11*d* is set up in advance so as to output an amount of compensation for the image data of the current frame, based on the response time of the liquid crystal display, corresponding to arbitrary preceding frame image data and arbitrary current frame image data.

The compensation unit 11*c* is similar to the one shown in FIG. 2; it uses the compensation values Dc1 to compensate the original current frame image data Di1 and outputs the compensated image data Dj1. The compensation unit 11*c* generates the compensated image data Dj1 by, for example, adding the compensation values Dc1 to the original current frame image data Di1.

Instead of this type of compensation unit, one that generates the compensated image data Dj1 by multiplying the original current frame image data Di1 by the compensation values Dc1 may be used.

Figure 9:
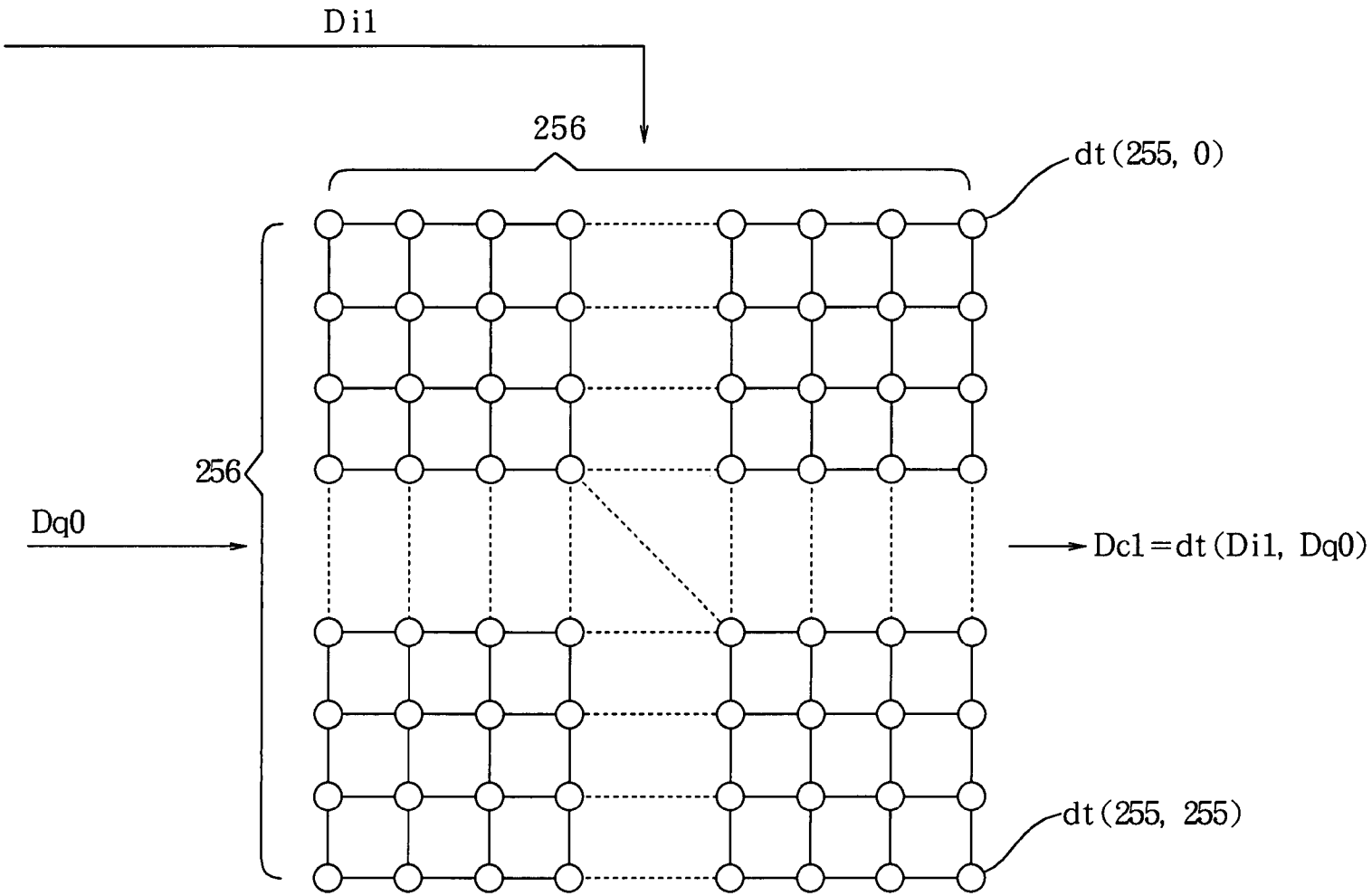
FIG. 9 is a diagram schematically illustrating the structure of the lookup table used in the second embodiment.

FIG. 9 schematically shows the structure of the lookup table 11*d*.

The part shown as a matrix in FIG. 9 is the lookup table 11*d*; the original current frame image data Di1 and preceding frame image data Dq0, which are given as addresses, are 8-bit image data taking on values from 0 to 255. The lookup table shown in FIG. 9 has a two-dimensional array of 256×256 data items, and outputs a compensation amount Dc1 =dt(Di1, Dq0) corresponding to the combination of the original current frame image data Di1 and the reconstructed preceding frame image data Dq0.

In this embodiment, as explained in FIG. 4, there are cases in which an interval longer than one frame interval is needed for the liquid crystal to reach the proper transmittance value, so when a brightness value in the current frame image changes, the response speed of the liquid crystal is improved by applying an increased or reduced voltage, so as to bring the transmittance to the desired value within one frame interval.

Figure 10:
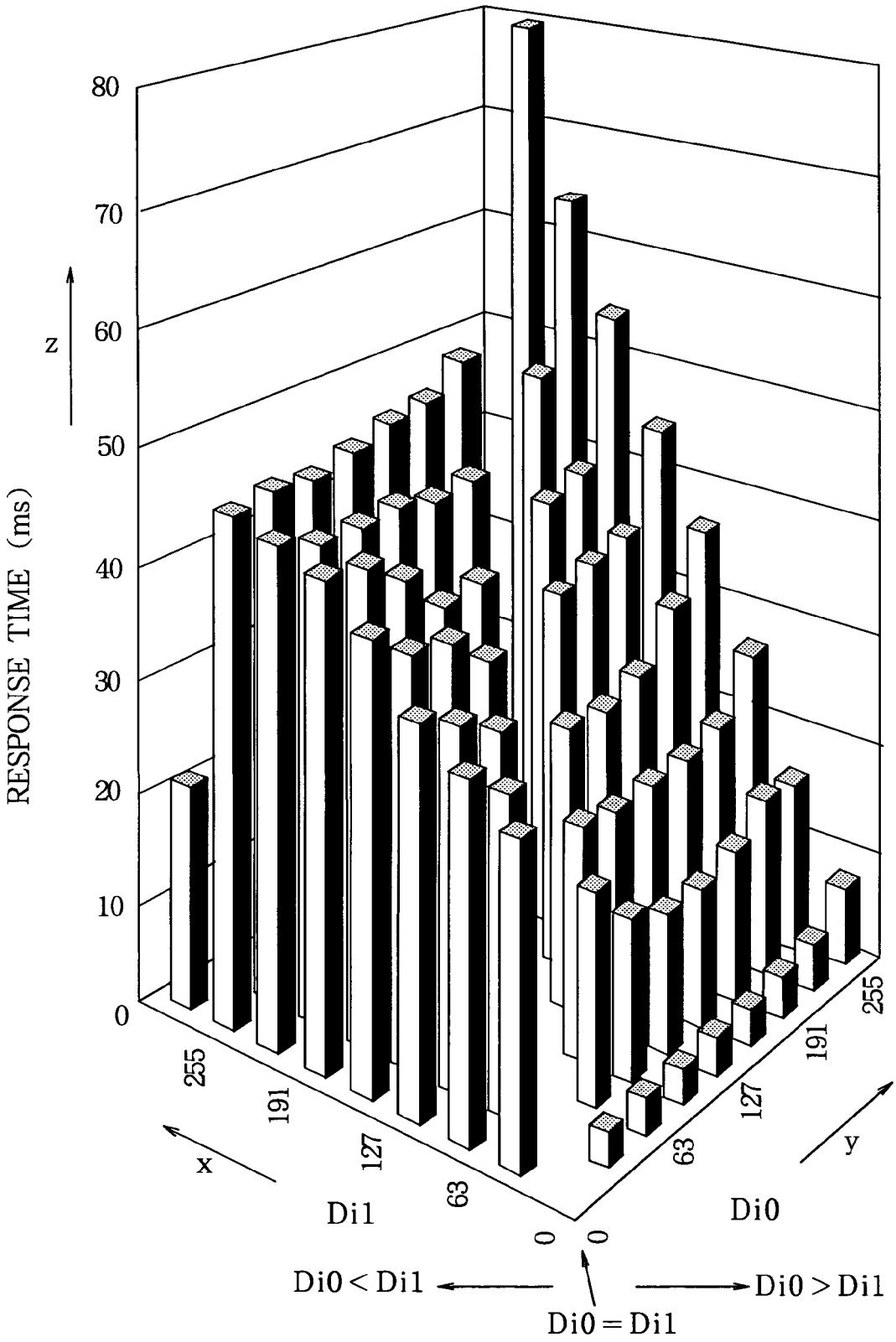
FIG. 10 is a diagram showing an example of response times of a liquid crystal, depending on changes in image brightness between the preceding frame and the current frame.

FIG. 10 shows an example of the response times of a liquid crystal corresponding to changes in image brightness between the preceding frame and the current frame.

In FIG. 10, the x axis represents the value of the current frame image data Di1 (the brightness value in the image in the current frame), the y axis represents the value of the preceding frame image data Di0 (the brightness value in the image in the previous frame), and the z axis represents the response time required by the liquid crystal to reach the transmittance corresponding to the brightness value of the current frame image data Di1 from the transmittance corresponding to the brightness value of the preceding frame image data Di0.

Whereas the preceding frame image data Di0 shown in FIG. 10 indicate the image data actually input one frame before the current frame image data Di1, the reconstructed preceding frame image data Dq0 shown in FIG. 9 are generated from the primary reconstructed preceding frame image data Db0 and the secondary reconstructed preceding frame image data Dp0 (by selecting one or the other, for example), and are thus obtained by reconstruction. The reconstructed preceding frame image data Dq0 are input to the lookup table, but the reconstructed preceding frame image data Dq0 include encoding and decoding error; the values of the preceding frame image data Di0 used in FIG. 10, and in FIGS. 11 and 14 which will be described below, have not been encoded and decoded and accordingly do not include encoding and decoding error.

If the brightness values of the current frame image in FIG. 10 are 8-bit values, there are 256×256 combinations of brightness values in the current frame image and the preceding frame image, and consequently 256×256 response times, but FIG. 10 has been simplified to show only 9×9 response speeds corresponding to combinations of brightness values.

As shown in FIG. 10, the response time varies greatly with the combination of brightness values in the current frame image and the preceding frame image, but when the images in the current and preceding frames have the same brightness value, the response time is zero, as shown in the diagonal direction from front to back in the quadrilateral in the z=0 plane in FIG. 10.

Figure 11:
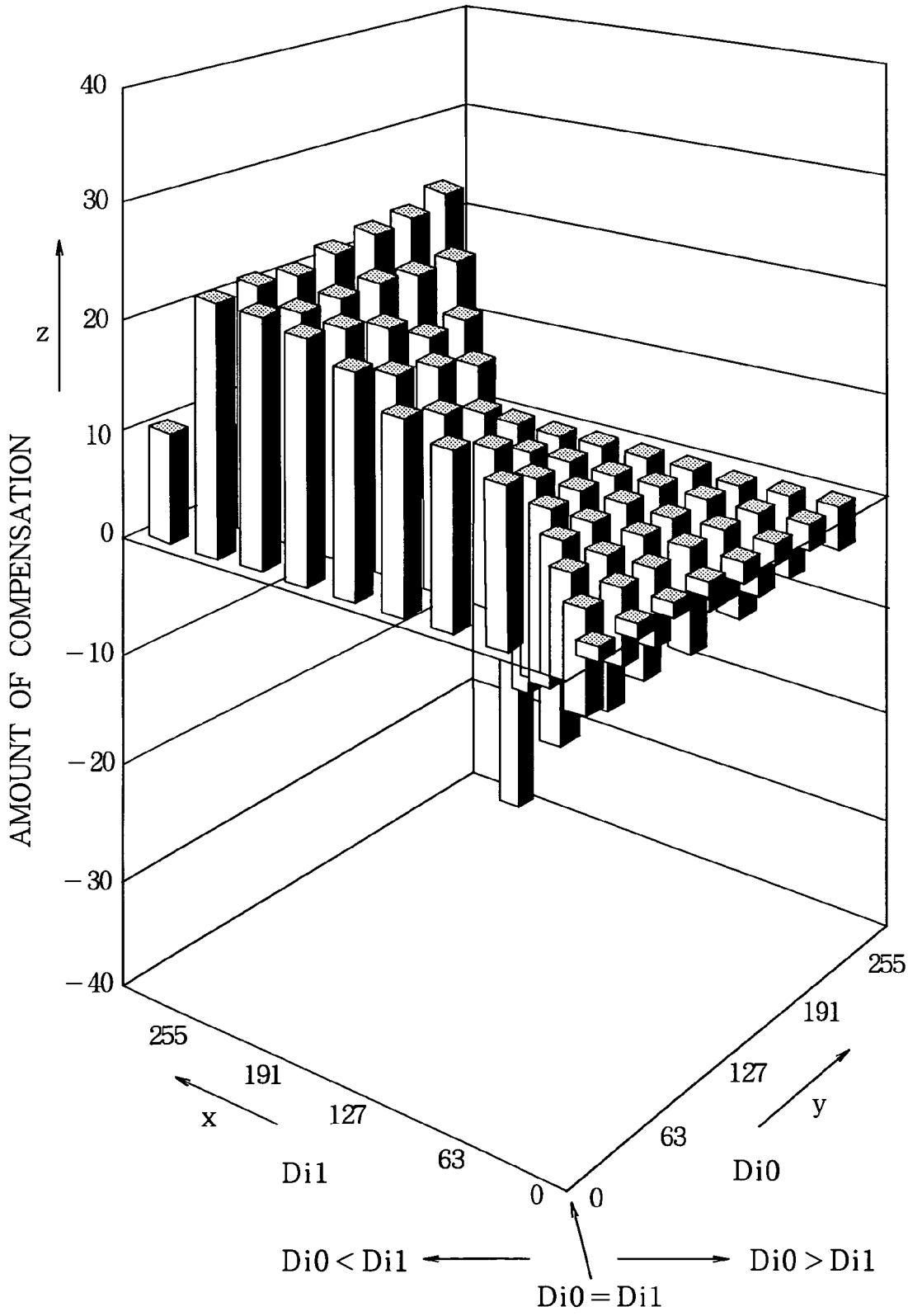
FIG. 11 is a diagram showing an example of amounts of compensation for the current frame image data obtained from the response times of the liquid crystal in FIG. 10.

FIG. 11 shows an example of amounts of compensation of the current frame image data Di1 determined from the liquid crystal response times in FIG. 10.

The compensation amount Dc1 shown in FIG. 11 is the compensation amount that should be added to the current frame image data Di1 in order for the liquid crystal to reach the transmittance corresponding to the value of the current frame image data Di1 when one frame interval has elapsed; the x and y axes are the same as in FIG. 10, but the z axis differs from FIG. 10 by representing the amount of compensation.

The amount of compensation may be positive (+) or negative (−), because the value of the current frame image data may be greater or less than the value of the preceding frame image data. The amount of compensation is positive on the left side in FIG. 11 and negative on the right side, and is zero in the case in which the images in the current and preceding frames have the same brightness value, shown in the diagonal direction from front to back in the quadrilateral in the z=0 plane as in FIG. 10. Also as in FIG. 10, if the brightness values of the current frame image are 8-bit values, there are 256×256 compensation amounts corresponding to combinations of brightness values in the current frame image and the preceding frame image, and consequently 256×256 response times, but FIG. 11 has been simplified to show only 9×9 compensation amounts corresponding to combinations of brightness values.

Because the response time of a liquid crystal depends on the brightness values of the images of the current frame and the preceding frame as shown in FIG. 10, and the compensation amount cannot always be obtained by a simple formula, it is sometimes advantageous to determine the compensation amount by use of a lookup table, rather than by computation; data for 256×256 compensation amounts corresponding to the brightness values of both the current frame image data Di1 and the preceding frame image data Di0 are stored in the lookup table in the compensated image data generator 11, as shown in FIG. 11.

The compensation amounts shown in FIG. 11 are set so that the larger compensation amounts correspond to the combinations of brightness values for which the response speed of the liquid crystal is slow. The response speed of a liquid crystal is particularly slow (the response time is particularly long) in changing from an intermediate brightness (gray) to a high brightness (white). Accordingly, the response speed can be effectively improved by assigning strongly positive or negative values to compensation amounts corresponding to combinations of preceding frame image data Di0 representing intermediate brightness and current frame image data Di1 representing high brightness.

Figure 12:
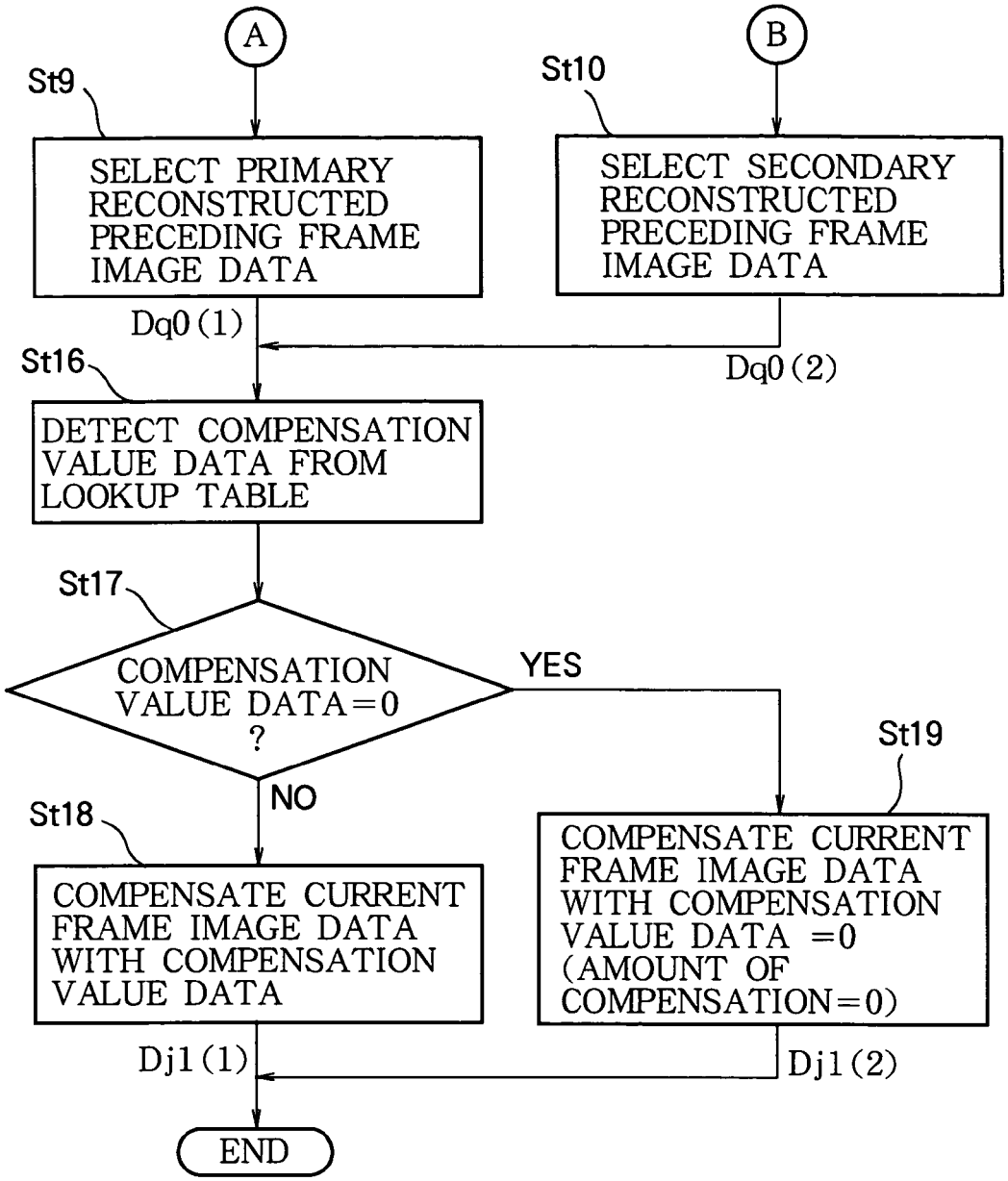
FIG. 12 is a flowchart showing an example of the image data processing method of the second embodiment.

FIG. 12 is a flowchart schematically showing an example of the image data processing method in the compensated image data generator 11 in the present embodiment. The process up to steps St9 and St10 in FIG. 12 is the same as in the example shown in FIGS. 6A and 6B; steps St1 to St8 are omitted from the drawing.

Upon receiving input of the current frame image data Di1 and the primary reconstructed preceding frame image data Db0, the compensated image data generator 11 detects the compensation amount from the lookup table 11*d* (St16) and decides whether the compensation amount data are zero or not (St17).

When the compensation amount data are not zero. (St17: NO) the compensated image data Dj1 (1) are generated and output by compensating the original current frame image data Di1, which are input separately, with the compensation amount data (St18).

When the compensation amount data are zero (St17: YES), the compensation by the zero compensation amount data is not applied to the current frame image data Di1 (compensation value=0 is applied), and the current frame image data Di1 are output without alteration as the compensated image data Dj1 (2) (St19).

The display unit 12 displays the compensated image data Dj1 by, for example, applying a voltage corresponding to a brightness value expressed thereby to the liquid crystal.

The compensation in the second embodiment is thus carried out by using a lookup table lid in which pre-calculated compensation amounts are stored, so that when the voltage level of a brightness signal or other signal in the image data of the current frame is compensated, the increase in the computational load placed on the processing unit necessary in order to calculate the image data for each pixel is less than in the first embodiment.

Third Embodiment

In the second embodiment it was shown that it is possible to reduce the computational load by using a lookup table 11*d* containing pre-calculated compensation values when compensating the voltage level of a brightness or other signal in the image data of the current frame, but the computational load can be further reduced by having the lookup table store compensated image data obtained by compensating the image data of the current frame with the compensation values. Accordingly, in the third embodiment described below, compensated image data obtained by compensating the image data of the current frame with the compensation values are stored in a lookup table, and the compensated image data of the current frame are output by use of the table.

Except for storing a table of compensated image data obtained by compensating the current frame image data in advance in the compensated image data generator 11 and using the compensated image data as the output of the compensated image data generator 11, the third embodiment is similar to the second embodiment, and redundant descriptions will be omitted.

Figure 13:
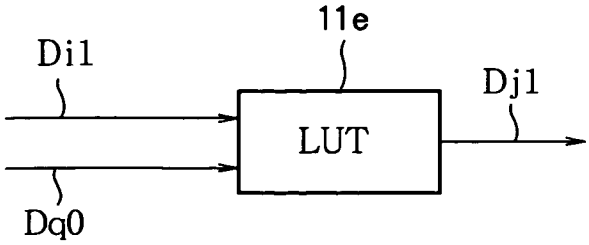
FIG. 13 is a block diagram showing another example of the compensated image data generator used in the second embodiment.

FIG. 13 shows the details of an example of the compensated image data generator 11 used in the third embodiment. This compensated image data generator 11 has a lookup table 11*e*.

The lookup table 11*e* takes the reconstructed preceding frame image data Dq0 and current frame image data Di1 as inputs, and outputs data prestored at an address (memory location) specified thereby as compensated image data Dj1, as will be explained in more detail below.

The lookup table 11*e* is set up in advance so as to output the values of the compensated image data Dj1 corresponding to arbitrary preceding frame image data and arbitrary current frame image data, based on the response time of the liquid crystal display.

Figure 14:
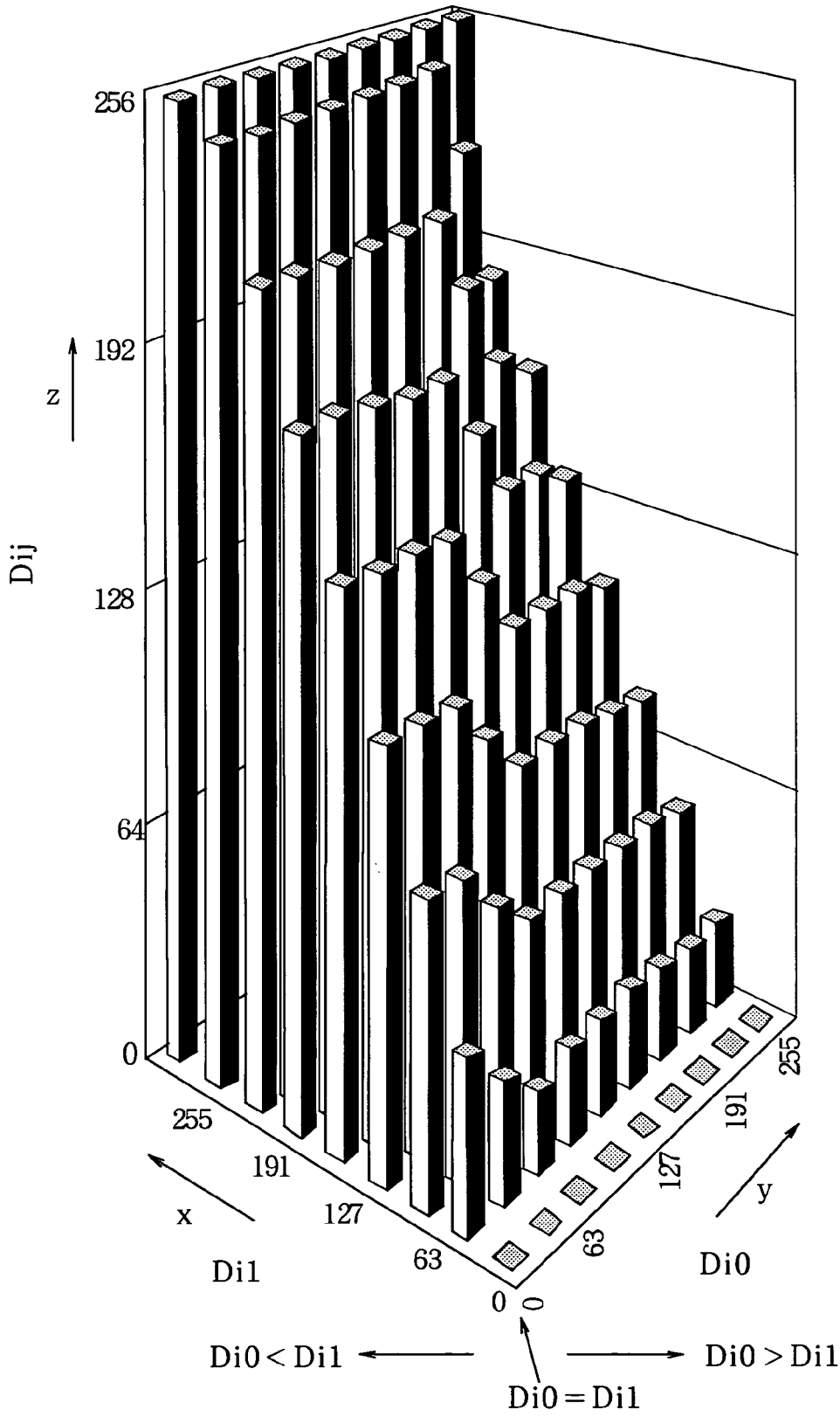
FIG. 14 is a diagram showing an example of compensated image data obtained from the amounts of compensation for the current frame image data shown in FIG. 11.

FIG. 14 shows an example of the compensated image data output obtained from the compensation amounts given in FIG. 11 for the original current frame image data Di1.

FIG. 14 shows compensated image data Dj1 in which the current frame image data Di1 have been compensated so that the liquid crystal will reach the transmittance corresponding to the value of the original current frame image data Di1 when one frame interval has elapsed; of the coordinate axes, only the vertical axis, which shows the values of the compensated image data Dj1, differs from FIG. 11.

Because the response time of a liquid crystal depends on the brightness values of the images of the current frame and the preceding frame as shown in FIG. 10, and the compensation amount cannot always be obtained by a simple formula, compensated image data Dj1 obtained by adding 256×256 compensation amounts, corresponding to the brightness values of both the current frame image data Di1 and the preceding frame image data Di0 as shown in FIG. 11, are stored in the lookup table 11*e* shown in FIG. 13. The compensated image data Dj1 are set so as not to exceed the displayable range of brightnesses of the display unit 12.

The values of the compensated image data Dj1 are set equal to the values of the current frame image data Di1 in the part of the lookup table 11*e* in which the current frame image data Di1 and the preceding frame image data Di0 are equal, that is, the part in which the image does not vary with time.

Figure 15:
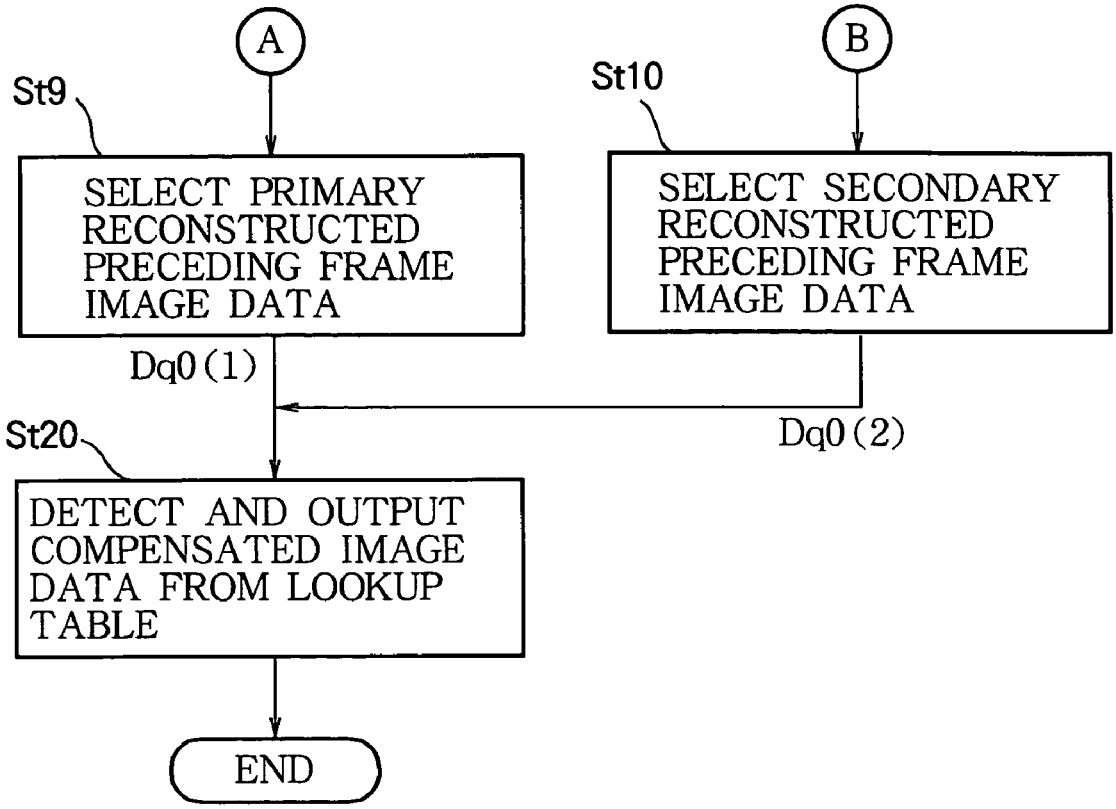
FIG. 15 is a flowchart schematically showing an example of the image data processing method of a third embodiment of the present invention.

FIG. 15 is a flowchart schematically showing an example of the image data processing method in the compensated image data generator 11 in the present embodiment. The process up to steps St9 and St10 in FIG. 15 is the same as in the example shown in FIG. 6; steps St1 to St8 are omitted from the drawing.

Regardless of whether the primary reconstructed preceding frame image data Db0 (St9) or the secondary reconstructed preceding frame image data Dp0 (St10) are selected as the reconstructed preceding frame image data Dq0, the compensated image data generator 11 accesses the lookup table 11*e* with the original current frame image data Di1 and the reconstructed preceding frame image data Dq0 as addresses, reads (detects) the compensated image data Dj1 from the lookup table 11*e*, and outputs the compensated image data Dj1 to the display unit 12 (St20). The display unit 12 displays the compensated image data Dj1 by, for example, applying a voltage corresponding to the brightness value thereof to the liquid crystal.

In this type of embodiment, since a lookup table including pre-calculated compensated image data Dj1 is used, there is no need to compensate the original current frame image data with compensation values output from the lookup table, so the load on the processing device can be further reduced.

Fourth Embodiment

The second and third embodiments described above shows examples of the reduction of the computational load by using a lookup table when compensating the current frame image data, but a lookup table is a type of memory device, and it is desirable to reduce the size of the memory device.

The present embodiment enables the size of the lookup table to be reduced; the present embodiment is similar to the third embodiment described above except for the internal processing of the compensated image data generator 11, so redundant descriptions will be omitted.

Figure 16:
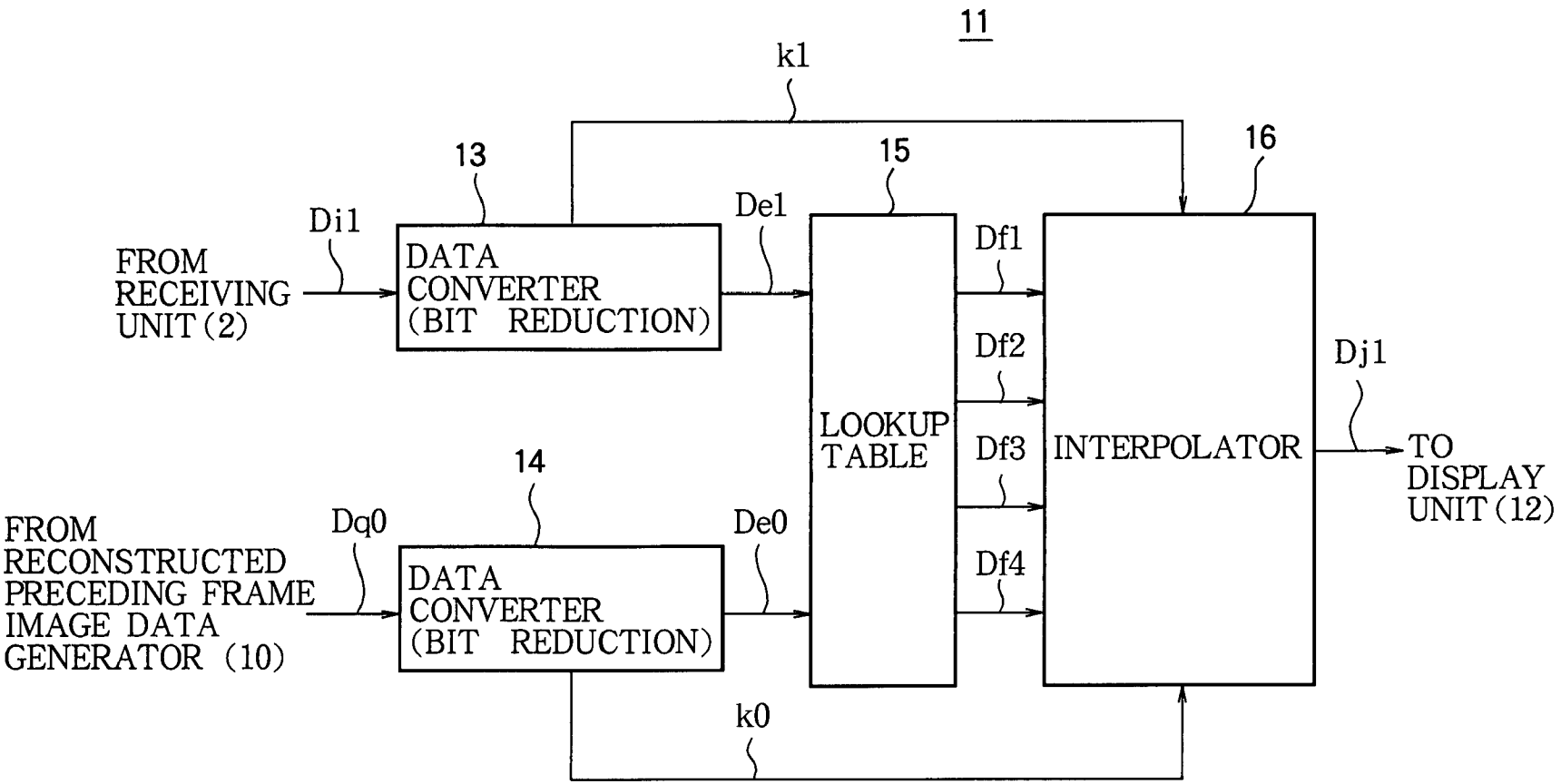
FIG. 16 is a block diagram showing the internal structure of the compensated image data generator in a fourth embodiment of the present invention.

FIG. 16 is a block diagram showing the internal structure of the compensated image data generator 11 in the present embodiment. This compensated image data generator 11 has data converters 13 and 14, a lookup table 15, and an interpolator 16.

Data converter 13 linearly quantizes the current frame image data Di1 from the receiving unit 2, reducing the number of bits from eight to three, for example, outputs current frame image data De1 with the reduced number of bits, and outputs an interpolation coefficient k1 that it obtains when reducing the number of bits.

Similarly, data converter 14 linearly quantizes the reconstructed preceding frame image data Dq0 input from the reconstructed preceding frame image data generator 10, reducing the number of bits from eight to three, for example, outputs preceding frame image data De0 with the reduced number of bits, and outputs an interpolation coefficient k0 that it obtains when reducing the number of bits.

Bit reduction is carried out in the data converters 13 and 14 by discarding low-order bits. When 8-bit input data are converted to 3-bit data as noted above, the five low-order bits are discarded.

If the five low-order bits were to be filled with zeros when the 3-bit data were restored to 8 bits, the restored 8-bit data would have smaller values than the 8-bit data before the bit reduction. The interpolator 16 performs a correction on the output of the lookup table 15 according to the low-order bits discarded in the bit reduction, as described below.

The lookup table 15 inputs the 3-bit current frame image data De1 and 3-bit preceding frame image data De0 and outputs four intermediate compensated image data Df1 to Df4. The lookup table 15 differs from the lookup table 11e in the third embodiment in that its input data are data with a reduced number of bits, and besides outputting intermediate compensated image data Df1 corresponding to the input data, it outputs three additional intermediate compensated image data Df2, Df3, and Df4 corresponding to combinations of data (data specifying a memory location as an address) having values greater by one.

The interpolator 16 generates the compensated image data Dj1 from the intermediate compensated image data Df1 to Df4 and the interpolation coefficients k0 and k1.

Figure 17:
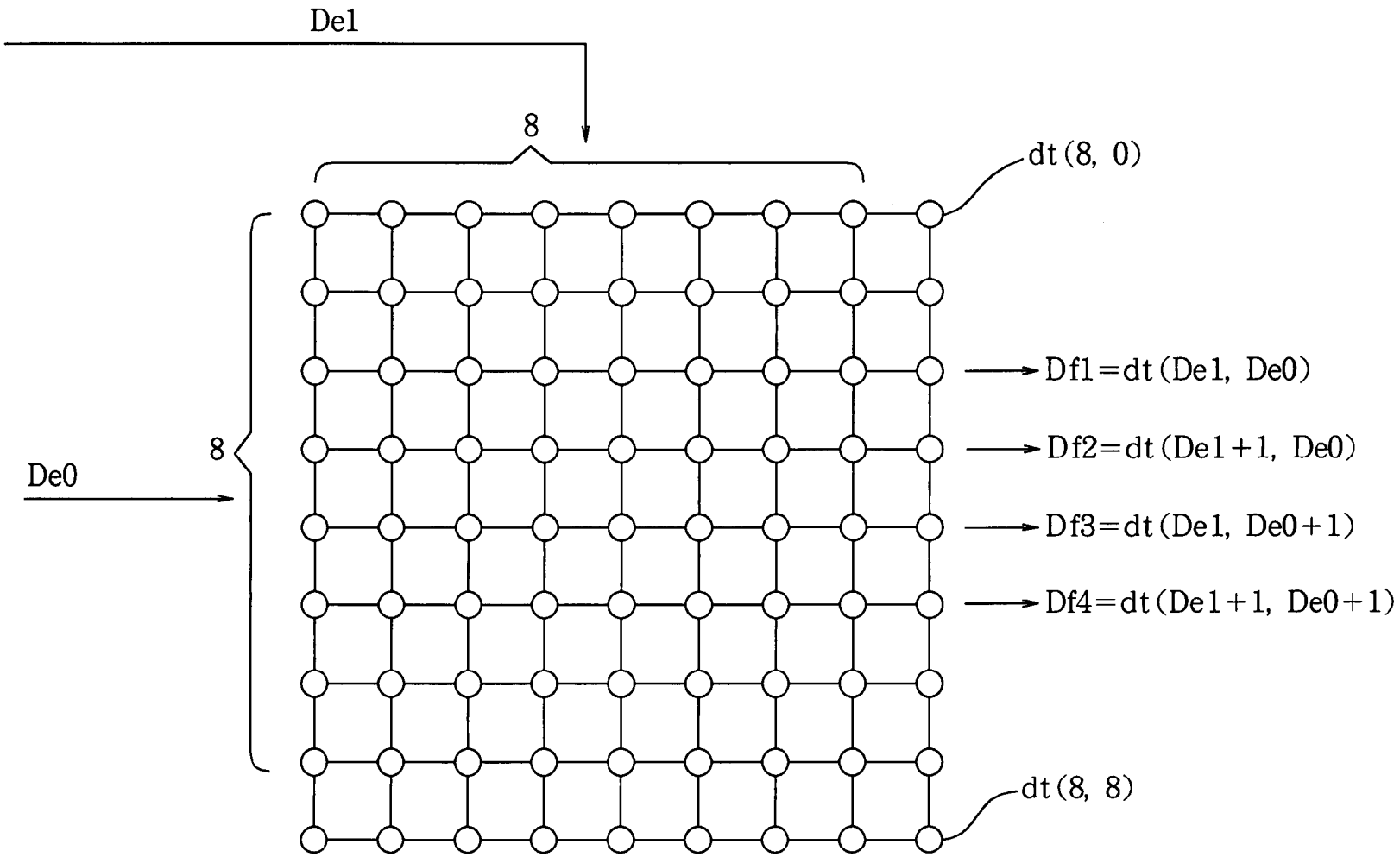
FIG. 17 is a diagram schematically showing an example of operations performed when a lookup table is used in the compensated image data generator.

FIG. 17 shows the structure of the lookup table 15. Image data De0 and De1 are 3-bit image data (with eight gray levels) taking on eight values from zero to seven. The lookup table 15 stores nine rows and nine columns of data arranged two-dimensionally. Of the nine rows and nine columns, eight rows and eight columns are specified by the input data; the ninth row and ninth column store output data (intermediate compensated image data) corresponding to data with a value greater by one.

The lookup table 15 outputs data dt(De1, De0) corresponding to the three-bit values of the image data Del and De0 as intermediate compensated image data Df1, and also outputs three data dt(De1+1, De0), dt(De1, De0+1), and dt(De1+1, De0+1) from the positions adjacent to the intermediate compensated image data Df1 as intermediate compensated image data Df2, Df3, and Df4, respectively.

The interpolator 16 uses the intermediate compensated image data Df1 to Df4 and the interpolation coefficients k1 and k0 to calculate the compensated image data Dj1 by the equation (5) below.

$$Dc1 = (1-k0)\times\{(1-k1)\times Df1 + k1\times Df2\} + k0\times\{(1-k1)\times Df3 + k1\times Df4\} \quad (5)$$

Figure 18:
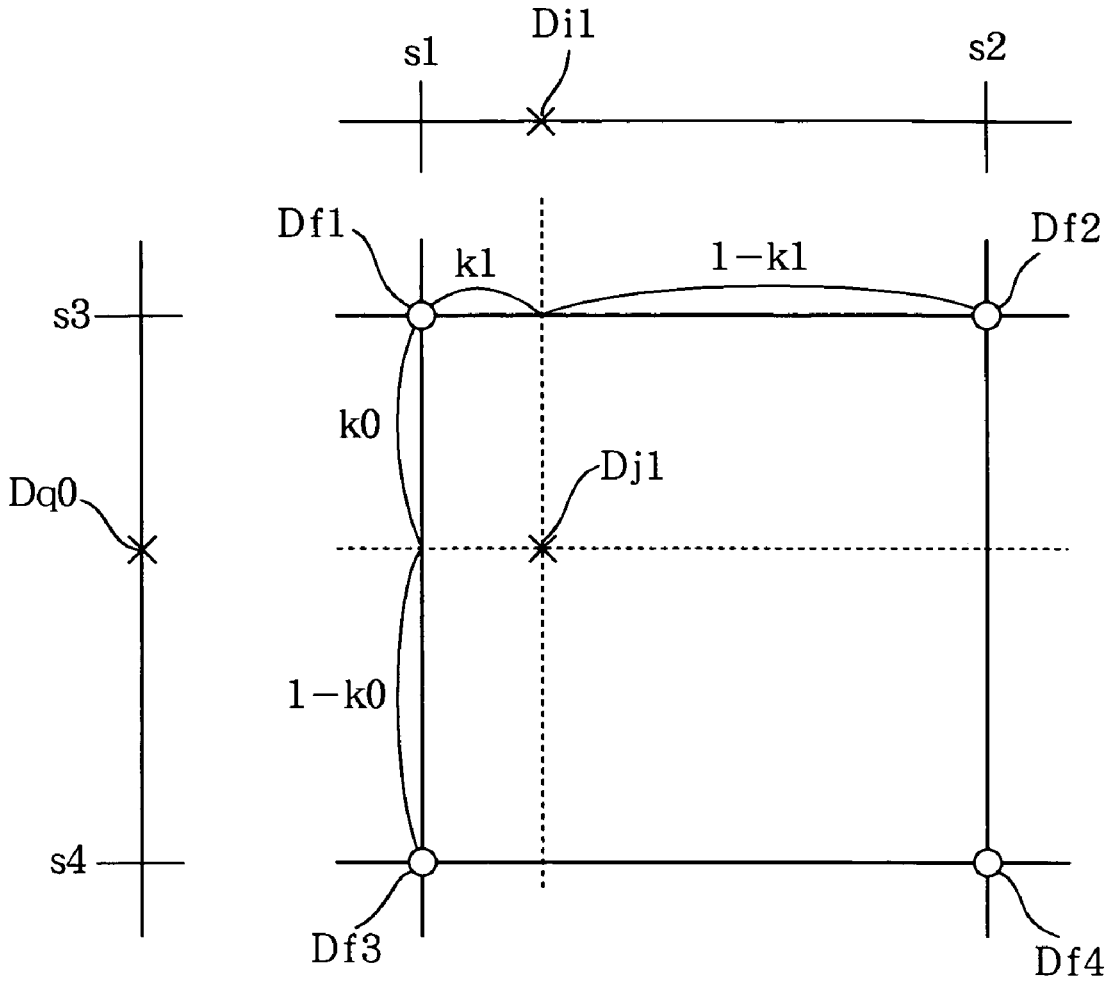
FIG. 18 is a diagram illustrating a method of calculating compensated image data by interpolation.

FIG. 18 illustrates the method of calculation of the compensated image data Dj1 represented by equation (5) above. Values s1 and s2 are thresholds used when the number of bits of the original current frame image data Di1 is converted by data conversion unit 13. Values s3 and s4 are thresholds used when the number of bits of the preceding frame image data Dq0 is converted by data conversion unit 14. Threshold s1 corresponds to the current frame image data De1 with the converted number of bits, threshold s2 corresponds to the image data De1+1 that is one gray level (with the converted number of bits) greater than image data De1, threshold s3 corresponds to the preceding frame image data De0 with the converted number of bits, and threshold s4 corresponds to the image data De0+1 that is one gray level (with the converted number of bits) greater than image data De0.

The interpolation coefficients k1 and k0 are calculated from the relation of the value before bit reduction to the bit reduction thresholds s1, s2, s3, s4, in other words, on the relation of the value expressed by the discarded low-order bits to the thresholds; the calculation is carried out by, for example, equations (6) and (7) below.

$$k1=(Di1-s1)/(s2-s1) \quad (6)$$

where, $s1<Di1\leqq s2$.

$$k0=(Dq0-s3)/(s4-s3) \quad (7)$$

where, $s3<Dq0<s4$.

The compensated image data Dj1 calculated by the interpolation operation shown in equation (5) above are output to the display unit 12. The rest of the operation is identical to that described in connection with the second or third embodiment.

Figure 19:
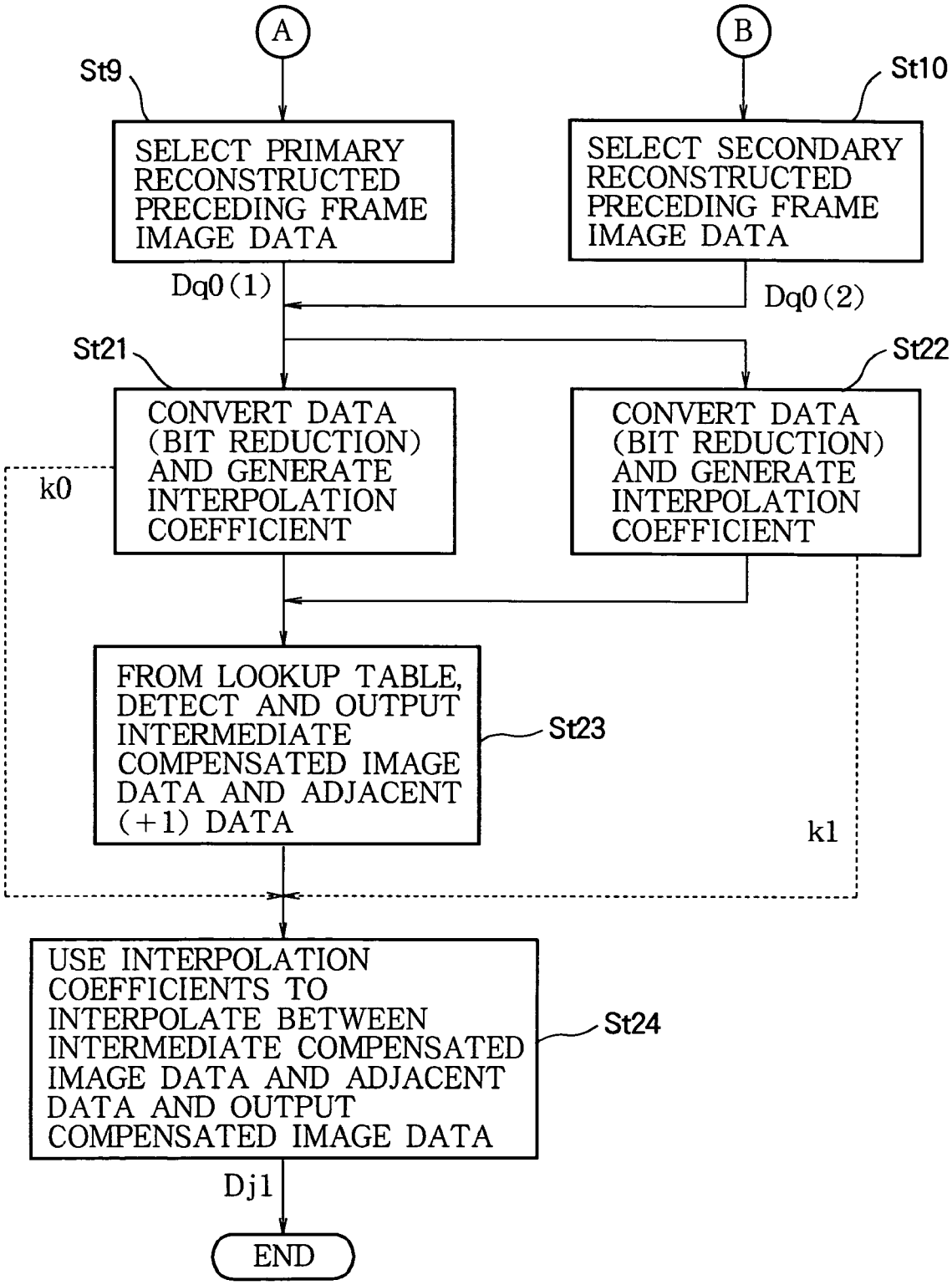
FIG. 19 is a flowchart schematically showing an example of the image data processing method of the fourth embodiment.

FIG. 19 is a flowchart schematically showing an example of the image data processing method in the compensated image data generator 11 in the present embodiment. The process up to steps St9 and St10 in FIG. 19 is the same as in the example shown in FIG. 6; steps St1 to St8 are omitted from the drawing.

Regardless of whether the primary reconstructed preceding frame image data Db0 (St9) or the secondary reconstructed preceding frame image data Dp0 (St10) are selected as the reconstructed preceding frame image data Dq0, in data converter 14, the compensated image data generator 11 outputs truncated preceding frame image data De0 obtained by reducing the number of bits of the reconstructed preceding frame image data Dq0, and outputs the interpolation coefficient k0 obtained in the bit reduction (St21). In data converter 13, it outputs truncated current frame image data De1 obtained by reducing the number of bits of the original current frame image data Di1, and outputs the interpolation coefficient k1 obtained in the bit reduction (St22).

Next, the compensated image data generator 11 detects and outputs from the lookup table 15 the intermediate compensated image data Df1 corresponding to the combination of the truncated preceding frame image data De0 and the truncated current frame image data Del, and the intermediate compensated image data Df2 to Df4 corresponding to the combination of data De0+1 having one added to the data value De0 and data De1, the combination of data De0 and data De1+1 having one added to the data value De1, and the combination of De1+1 having one added to the data value De1 and data De0+1 having one added to the data value De0 (St23).

Interpolation is then performed in the interpolator 16, according to the compensated data Df1 to Df4, interpolation coefficient k0, and interpolation coefficient k1, as explained with reference to FIG. 18, to generate the interpolated compensated image data Dj1. The compensated image data Dj1 thus generated become the output of the compensated image data generator 11 (St24).

Calculating the compensated image data Dj1 by performing interpolation using the interpolation coefficients k0 and k1 and the four compensated data Df1, Df2, Df3, Df4 corresponding to the data (De0, De1) obtained by converting the number of bits of the original current frame image data Di1 and the reconstructed preceding frame image data Dq0 and the adjacent data (De1+1, De0), (De1, De0+1), and (De1+1, De0+1) as explained above can reduce the effect of quantization error in the data converters 13, 14 on the compensated image data Dj1.

The number of bits after data conversion by the data conversion units 13 and 14 is not limited to three; any number of bits may be selected provided the number of bits enables compensated image data Dj1 to be obtained with an accuracy that is acceptable in practice (according to the purpose of use) by interpolation in the interpolator 16. The number of data items in the lookup table memory unit 15 naturally varies depending on the number of bits after quantization. The number of bits after data conversion by the data converters 13 and 14 may differ, and it is also possible not to implement one or the other of the data converters.

Furthermore, in the example above, the data converters 13 and 14 performed bit reduction by linear quantization, but nonlinear quantization may also be performed. In that case, the interpolator 16 is adapted to calculate the compensated image data Dj1 by use of an interpolation operation employing a higher-order function, instead of by linear interpolation.

When the number of bits is converted by nonlinear quantization, the error in the compensated image data Dj1 accompanying bit reduction can be reduced by raising the quantization density in areas in which the compensated image data change greatly (areas in which there are large differences between adjacent compensated image data.

In the present embodiment, compensated image data can be determined accurately even if the size of the lookup table used for determining the compensated image data is reduced.

In the fourth embodiment as described above, the lookup table is adapted to output intermediate compensated image data Df1, Df2, Df3, and Df4, and the compensated image data Dj1 are calculated by performing interpolation using these intermediate compensated image data. A lookup table that outputs intermediate compensation values instead of intermediate compensated image data may be used, however, and compensation values may be determined by performing interpolation using the intermediate compensation values, subsequent operations being carried out as in the second embodiment to calculate compensated image data Dj1 in which the original current frame image data Di1 are compensated by using these compensation values.

Fifth Embodiment

Figure 20:
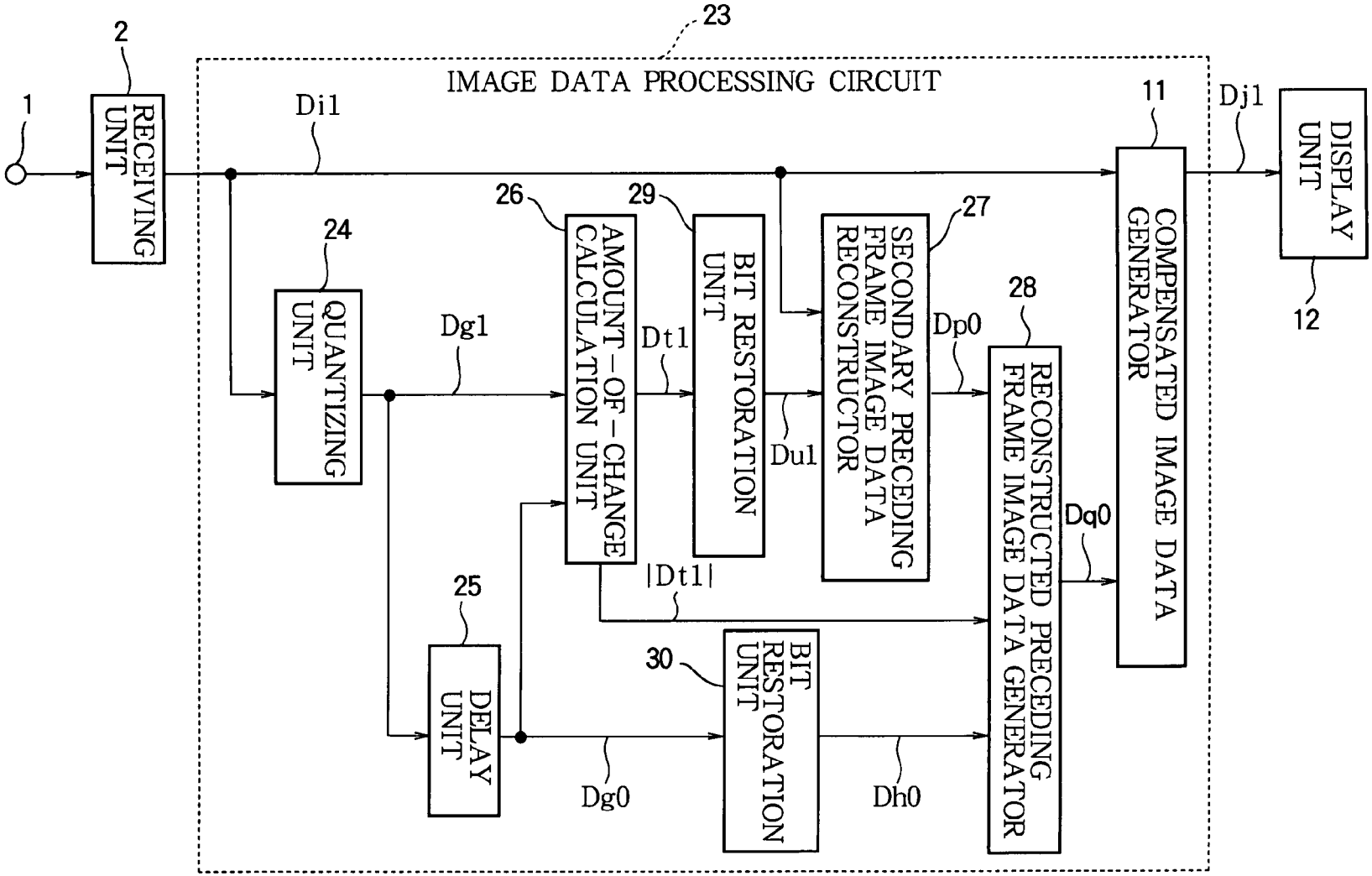
FIG. 20 is a block diagram showing the configuration of a liquid crystal display driving device according to a fifth embodiment of the present invention.

FIG. 20 is a block diagram showing the structure of a liquid crystal display driving device according to a fifth embodiment of the present invention.

The driving device in the fifth embodiment is generally the same as the driving device in the first embodiment. The differences are that the encoding unit 4 of the first embodiment is replaced by a quantizing unit 24, the amount-of-change calculation unit 8, secondary preceding frame image data reconstructor 9, and reconstructed preceding frame image data generator 10 are replaced by another amount-of-change calculation unit 26, secondary preceding frame image data reconstructor 27, and reconstructed preceding frame image data generator 28, the decoding units 6 and 7 of the first embodiment are omitted, and bit restoration units 29 and 30 are provided.

In the first embodiment, the encoding unit 4 was used to compress the data and the compressed image data were delayed in the delay unit 5, and the decoders 6 and 7 were used to decompress the data, whereby the size of the frame memory used in the delay unit 5 could be reduced, but in the fifth embodiment, the image data are compressed by use of the quantizing unit 24, and decompressed by use of the bit restoration units 29 and 30.

The quantizing unit 24 reduces the number of bits in the original current frame image data Di1 by performing linear or nonlinear quantization, and outputs the quantized data, denoted data Dg1, which have a reduced number of bits. If the number of bits is reduced by quantization, the amount of data to be delayed in the delay unit 25 is reduced; accordingly, the size of the frame memory constituting the delay unit can be reduced.

An arbitrary number of bits can be selected as the number of bits after quantization, to produce a predetermined amount of image data after bit reduction. If 8-bit data for each of the colors red, green, and blue are output from the receiving unit 2, the amount of image data can by reduced by half by reducing each to four bits. The quantizing unit may also quantize the red, green, and blue data to different numbers of bits. The amount of image data can be reduced effectively by, for example, quantizing blue, to which human visual sensitivity is generally low, to fewer bits than the other colors.

In the description below, the original current frame image data Di1 are 8-bit data, linear quantization is carried out by extracting a certain number of high-order bits, such as the four upper bits, and 4-bit data are generated.

The quantized image data Dg1 output from the quantizing unit 24 are input to the delay unit 25 and amount-of-change calculation unit 26.

The delay unit 25 receives the quantized data Dg1, and outputs image data preceding the original current frame image data Di1 by one frame; that is, it outputs quantized image data Dg0 in which the image data of the preceding frame are quantized.

The delay unit 25 comprises a memory that stores the quantized image data Dg1 of the preceding frame for one frame interval. Accordingly, the fewer bits of image data there are after quantization of the original current frame image data Di1, the smaller the size of the memory constituting the delay unit 25 can be.

The amount-of-change calculation unit 26 subtracts the quantized image data Dg1 expressing the image of the current frame from the quantized image data Dg0 expressing the image of the preceding frame to obtain an amount of change Bv1 therebetween and its absolute value |Bv1|. That is, it generates and outputs amount-of-change data Dt1 and absolute amount-of-change data |Dt1| representing, with a reduced number of bits, the amount of change and its absolute value. The amount of change Bv1 will also be referred to as the first amount of change, and the amount-of-change data Dt1 and absolute amount-of-change data |Dt1| will similarly be referred to as the first amount-of-change data and first absolute amount-of-change data.

Thus, the amount-of-change calculation unit 26 performs a function corresponding to the amount-of-change calculation circuit comprising the combination of the amount-of-change calculation unit 8 and the decoding unit 6 in the first embodiment.

Bit restoration unit 29 outputs amount-of-change data Du1 expressing the amount of change Bv1 in the same number of bits as the original image data Di1, based on the amount-of-change data Dt1 output from the amount-of-change calculation unit 26.

The amount-of-change data Du1 are obtained by bit restoration, as will be described below.

Bit restoration unit 30 outputs bit-restored original image data Dh0 by adjusting the number of bits of the quantized image data Dg0 output from the delay unit 25 to the number of bits of the original current frame image data Di1. The bit-restored original image data Dh0 correspond to the decoded image data Db0 in the first embodiment etc., and like the decoded image data Db0 in the first embodiment, will also be referred to as primary reconstructed preceding frame image data.

The secondary preceding frame image data reconstructor 27 receives the original current frame image data Di1 and the bit-restored amount-of-change data Du1, and generates and outputs secondary reconstructed preceding frame image data Dp0 corresponding to the image in the preceding frame by adding the amount-of-change data Du1 to the image data Di1.

Because the number of bits of the amount-of-change data Dt1 is, like the number of bits of the quantized image data Dg0 and Dg1, less than in the original current frame image data Di1, before being added to the original current frame image data Di1, the number of bits in the amount-of-change data Dt1 must be made equal to the number of bits in the original current frame image data Di1. Bit restoration unit 29 is provided for this purpose; it generates the bit-restored amount-of-change data Du1 by performing a process that adjusts the number of bits of the data Dt1 expressing the amount of change Bv1 according to the number of bits in the original current frame image data Di1.

If the quantizing unit 24 quantizes 8-bit data to 4-bit data, for example, the amount-of-change data Dt1 are obtained by a subtraction operation on the 4-bit quantized data Dg0 and Dg1, so the amount-of-change data Dt1 are represented by a sign bit s and four data bits b7, b6, b5, b4.

In the amount-of-change data Dt1, these bits are arranged in the order s, b7, b6, b5, b4, s being the most significant bit.

If 0's are inserted into the lower four bits to adjust the number of bits for the purpose of bit restoration in the bit restoration unit 29, the data after bit restoration are s, b7, b6, b5, b4, 0, 0, 0, 0; if 1's are inserted, the data are s, b7, b6, b5, b4, 1, 1, 1, 1. If the same value as in the upper bits is inserted into the lower bits, s, b7, b6, b5, b4, b7, b6, b5, b4, can be used.

The amount-of-change data Du1 obtained in this way after bit restoration are added to the original current frame image data Di1 to obtain the secondary reconstructed preceding frame image data Dp0; if the original current frame image data Di1 are 8-bit data, then the secondary reconstructed preceding frame image data Dp0 must be restricted to the interval from 0 to 255.

If the data ate quantized to a number of bits other than four bits in the quantizing unit 24, the number of bits can be adjusted in a way similar to the above, or by using a combination of the ways described above.

Based on the absolute amount-of-change data |Dt1| output by the amount-of-change calculation unit 26, the reconstructed preceding frame image data generator 28 outputs the bit-restored primary reconstructed preceding frame image data Dh0 output by bit restoration unit 30 as the reconstructed preceding frame image data Dq0 when the absolute amount-of-change data |Dt1| is greater than a threshold SH0, which may be set arbitrarily, and outputs the secondary reconstructed preceding frame image data Dp0 output by the secondary preceding frame image data reconstructor 27 as the reconstructed preceding frame image data Dq0 when the absolute amount-of-change data |Dt1| is less than SH0.

Bit restoration unit 30 adjusts the number of bits of the quantized image data Dg0 to the number of bits of the current frame image data Di1 and outputs the bit-restored primary reconstructed preceding frame image data Dh0 as noted above; it is provided because it is desirable to adjust the preceding frame quantized image data Dg0 to the number of bits of the current frame image data Di1 before input to the reconstructed preceding frame image data generator 28.

Available methods of adjusting the number of bits in bit restoration unit 30 include setting the lacking low-order bits to 0 or to 1, or inserting the same value as a plurality of upper bits into the lower bits.

The case in which the quantizing unit 24 quantizes 8-bit data to 4-bit data, for example, and the quantized 4-bit data are adjusted to 8 bits in bit restoration unit 30 will be described. If the 4-bit data after quantization are, from the most significant bit, b7, b6, b5, b4, then inserting 0's into the lower four bits produces b7, b6, b5, b4, 0, 0, 0, 0 and inserting 1's produces b7, b6, b5, b4, 1, 1, 1, 1. If the same value as in the upper bits is inserted into the lower bits, b7, b6, b5, b4, b7, b6, b5, b4, can be used.

From the current frame image data Di1 and the reconstructed preceding frame image data Dq0, the compensated image data generator 11 outputs compensated image data Dj1 compensated so that when a brightness value in the current frame image changes from the image data of the preceding frame image, the liquid crystal will achieve the transmittance corresponding to the brightness value in the current frame image within one frame interval.

The voltage level of a signal for displaying the image in the original current frame image data Di1 is compensated here so as to compensate for the delay due to the response speed characteristic of the display unit 12 of the liquid crystal display device.

The compensated image data generator 11 compensates the voltage level of the signal for displaying the image corresponding to the image data of the current frame, in correspondence to the response speed characteristic indicating the time from the input of image data to the liquid crystal display unit 12 to the display thereof and the amount of change between the image data of the preceding frame and the image data of the current frame input to the liquid crystal display driving device.

Other operations are the same as in the first embodiment, so a detailed description will be omitted.

Figure 21A:
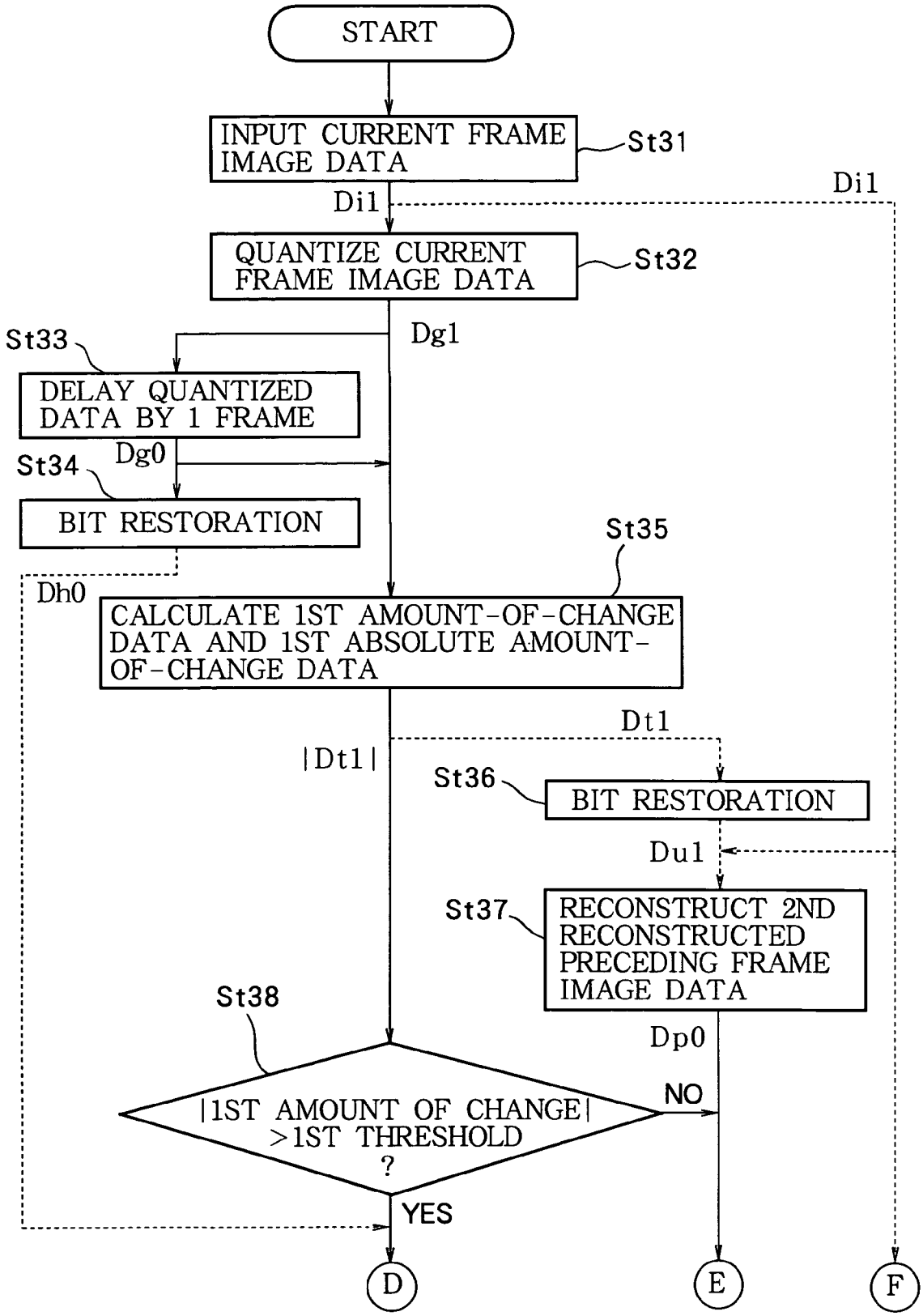
FIGS. 21A and 21B constitute a flowchart schematically showing an example of the image data processing method of the image data processing circuit shown in FIG. 20.
Figure 21B:
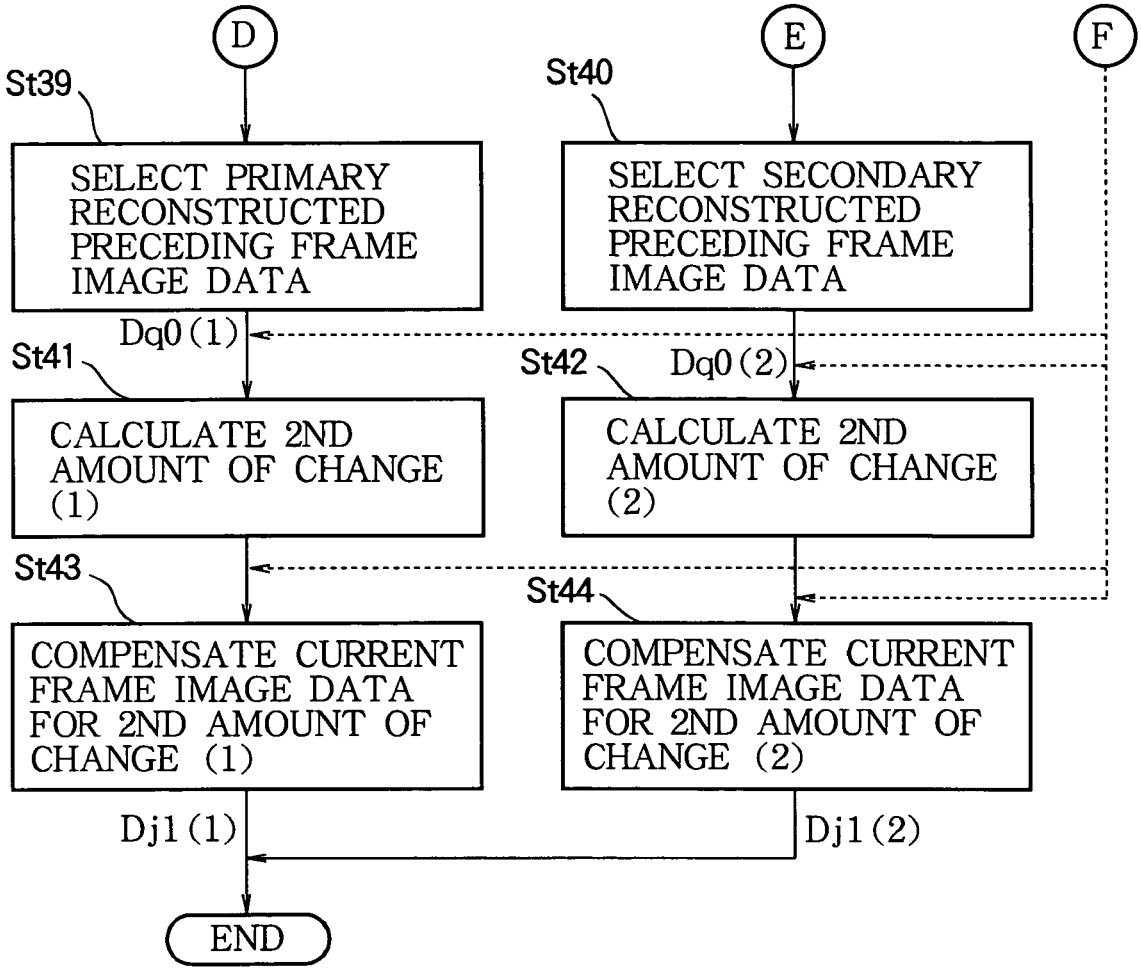

FIG. 21 is a flowchart schematically showing an example of the image data processing method of the image data processing circuit shown in FIG. 20.

First, when the original current frame image data Di1 is input from the input terminal 1 through the receiving unit 2 to the image data processing circuit 23 (St31), the quantizing unit 24 compressively quantizes the original current frame image data Di1 and outputs the quantized image data Dg1, the data size of which has been reduced (St32). The quantized image data Dg1 are input to the delay unit 25, which outputs the quantized image data Da1 with a delay of one frame. Accordingly, when the quantized image data Dg1 are input, the quantized image data Dg0 of the preceding frame are output from the delay unit 25 (St33).

By restoring bits to the quantized image data Dg0 output from the delay unit 25, bit restoration unit 30 generates bit-restored image data, more specifically, primary reconstructed preceding frame image data Dh0 (St34).

The quantized image data Dg1 output from the quantizing unit 24 and the quantized image data Dg0 output from the delay unit 25 are input to the amount-of-change calculation unit 26, and the difference obtained, for instance, by subtracting quantized image data Dg1 from quantized image data Dg0 is output as amount-of-change data Dt1 for each pixel, the absolute value of the difference also being output as absolute amount-of-change data |Dt1| (St35). The amount-of-change data Dt1 indicates the temporal change of each item of image data in the frame by using the quantized image data of two temporally differing frames, such as quantized image data Dg0 and quantized image data Dg1.

Bit restoration unit 29 generates and outputs bit-restored amount-of-change data Du1 by restoring bits to the amount-of-change data Dt1 (St36).

The bit-restored amount-of-change data Du1 are input to the secondary preceding frame image data reconstructor 27, which generates and outputs the secondary reconstructed preceding frame image data Dp0 by adding the bit-restored amount-of-change data Du1 and the original current frame image data Di1, which are input separately (St37).

The bit-reduced absolute amount-of-change data |Dt1| are input to the reconstructed preceding frame image data generator 28, which decides whether the first absolute amount-of-change data |Dt1| are greater than a first threshold (St38). If the absolute amount-of-change data |Dt1| are greater than the first threshold (St38: YES), the reconstructed preceding frame image data generator 10 selects, from the bit-restored image data, that is, the primary reconstructed preceding frame image data Dh0 and the secondary reconstructed preceding frame image data Dp0, the primary reconstructed preceding frame image data Dh0 and outputs the primary reconstructed preceding frame image data Dh0 to the compensated image data generator 11 as the reconstructed preceding frame image data Dq0 (St39). When the absolute amount-of-change data |Dt1| are not greater than the first threshold (St38: NO), the reconstructed preceding frame image data generator 10 selects the secondary reconstructed preceding frame image data Dp0 rather than the primary reconstructed preceding frame image data Dh0 and outputs the secondary reconstructed preceding frame image data Dp0 to the compensated image data generator 11 as the reconstructed preceding frame image data Dq0 (St40).

When the primary reconstructed preceding frame image data Dh0 are input as the reconstructed preceding frame image data Dq0, the compensated image data generator 11 calculates the difference between the primary reconstructed preceding frame image data Dh0 and the original current frame image data Di1, that is, the second amount of change Dw1 (1) (St41), calculates a compensation value from the response time of the liquid crystal corresponding to the second amount of change Dw1 (1), and generates and outputs compensated image data Dj1 (1) by using that compensation value to compensate the original current frame image data Di1 (St43).

When the secondary reconstructed preceding frame image data Dp0 are input as the reconstructed preceding frame image data Dq0, the compensated image data generator 11 calculates the difference between the secondary reconstructed preceding frame image data Dp0 and the original current frame image data Di1, that is, the second amount of change Dw1 (2) (St42), calculates a compensation value from the response time of the liquid crystal corresponding to the second amount of change Dw1 (2), and generates and outputs the compensated image data Dj1 (2) by using the compensation value to compensate the original current frame image data Di1 (St44).

The compensation in steps St43 and St44 compensates the voltage level of a brightness signal or other display signal corresponding to the image data of the current frame in accordance with the response speed characteristic representing the time from input of image data to the liquid crystal display unit 12 until display of the image, and the amount of change from the preceding frame to the current frame in the image data input to the liquid crystal display driving device.

If the first amount-of-change data Dt1 are zero, the second amount of change Dw1 (2) is also zero and the compensation value is zero, so the original current frame image data Di1 are output without compensation as the compensated image data Dj1 (2).

The display unit 12 displays the compensated image data Dj1 by, for example, applying a voltage corresponding to a brightness value expressed thereby to the liquid crystal.

In the description given above, the reconstructed preceding frame image data generator 28 selects either the secondary reconstructed preceding frame image data Dp0 or the primary reconstructed preceding frame image data Dh0 in accordance with a threshold SH0 which can be set arbitrarily, but the processing in the reconstructed preceding frame image data generator 28 is not limited to this.

For instance, two thresholds SH0 and SH1 may be provided in the reconstructed preceding frame image data generator 28, which may be configured to output the reconstructed preceding frame image data Dq0 as follows, according to the relationships among these thresholds SH0 and SH1 and the absolute amount-of-change data |Dt1|.

The relationship between SH0 and SH1 is given by the following expression (8):

$$SH1 > SH0 \tag{8}$$

When |Dt1|<SH0, $$Dq0 = Dp0 \tag{9}$$

When $SH0 \le |Dt1| \le SH1$, (10)

$$Dq0 = Dh0 \times (|Dt1| - SH0)/(SH1 - SH0) + Dp0 \times \{1 - (|Dt1| - SH0)/(SH1 - SH0)\}$$

When SH1<|Dt1|, $$Dq0 = Dh0 \tag{11}$$

When the absolute amount-of-change data Dt1 are between the thresholds SH0 and SH1, the preceding frame image data Dq0 are calculated according to the primary reconstructed preceding frame image data Db0 and the secondary reconstructed preceding frame image data Dp0 as in equations (9) to (11). That is, the primary reconstructed preceding frame image data Dh0 and the secondary reconstructed preceding frame image data Dp0 are combined in a ratio corresponding to the position of the absolute amount-of-change data |Dt1| in the range between threshold SH0 and threshold SH1 (calculated by adding their values multiplied by coefficients corresponding to closeness to the thresholds) and output as the reconstructed preceding frame image data Dq0. Accordingly, a step-like transition in the reconstructed preceding frame image data Dq0 can be avoided at the boundary between the range in which the amount of change is small and can be appropriately processed as if there were no change, and the range that is appropriately processed as if there was a large change, and near this boundary, processing can be carried out as a compromise between the processing when there is no change and the processing when there is a large change.

The quantizing unit used in the fifth embodiment can be realized with a simpler circuit than the encoding unit in the first embodiment, so the structure of the image data processing circuit in the fifth embodiment can be simplified.

Modifications can be made to the fifth embodiment similar to the modifications to the first embodiment that were described with reference to the second to fourth embodiments. In particular, lookup tables can be used as described in the second and third embodiments, and bit reduction and interpolation are possible as described in the fourth embodiment.

Data compression was carried out by encoding in the first to fourth embodiments and by quantization in the fifth embodiment, but data compression can also be carried out by other methods.

Those skilled in the art will recognize that further variations are possible within the scope of the invention, which is defined by the appended claims.

What is claimed is:

1. An image data processing method for determining a voltage applied to a liquid crystal in a liquid crystal display device based on image data representing a plurality of frame images successively displayed on the liquid crystal display device, comprising:

generating primary reconstructed preceding frame image data representing an image of a preceding frame by compressing current frame image data representing an image of a current frame, delaying the compressed image data by one frame interval, and decompressing the delayed image data;

calculating an amount of change between the image of the current frame and the image of the preceding frame;

generating secondary reconstructed preceding frame image data representing the image of the preceding frame, based on the current frame image data and said amount of change;

generating reconstructed preceding frame image data representing the image of the preceding frame, based on an absolute value of said amount of change, the primary reconstructed preceding frame image data, and the secondary reconstructed preceding frame image data; and generating compensated image data having compensated values representing the image of the current frame, based on the current frame image data and the reconstructed preceding frame image data.

2. The image data processing method of claim 1, wherein the current frame image data are compressed by encoding and decompressed by decoding, further comprising decoding the encoded current frame image data to generate non-delayed decoded current frame image data, the amount of change being calculated by comparing the primary reconstructed preceding frame image data with the non-delayed decoded current frame image data.

3. The image data processing method of claim 1, wherein the current frame image data are compressed by quantizing and decompressed by restoring bits, the amount of change being calculated by comparing the delayed image data with the quantized current frame image data.

4. The image data processing method according to claim 1, wherein generating the reconstructed preceding frame image data comprises:

selecting the primary reconstructed preceding frame image data as the reconstructed preceding frame image data when the absolute value of said amount of change is larger than a predetermined threshold; and selecting the secondary reconstructed preceding frame image data as the reconstructed preceding frame image data when the absolute value of said amount of change is smaller than the predetermined threshold.

5. The image data processing method according to claim 1, wherein generating the reconstructed preceding frame image data comprises:

selecting the primary reconstructed preceding frame image data as the reconstructed preceding frame image data when the absolute value of said amount of change is larger than a first predetermined threshold;

selecting the secondary reconstructed preceding frame image data as the reconstructed preceding frame image data when the absolute value of said amount of change is smaller than a second predetermined threshold which is smaller than the first threshold; and combining the primary reconstructed preceding frame image data and the secondary reconstructed preceding frame image data in proportion to distances of said amount of change from the first threshold and the second threshold, when said amount of change is between the first threshold and the second threshold.

6. The image data processing method according to claim 1, wherein generating the compensated image data comprises inputting the current frame image data and the reconstructed preceding frame image data to a lookup table.

7. The image data processing method according to claim 6, wherein:

at least one of the current frame image data and the reconstructed preceding frame image data undergoes bit reduction by quantization before being input to the lookup table;

interpolation coefficients are determined when the bit reduction takes place, based on a positional relation of the image data before the bit reduction to thresholds used for the bit reduction; and interpolation is carried out on the output of the lookup table by using the interpolation coefficients.

8. An image data processing circuit for determining a voltage applied to a liquid crystal in a liquid crystal display device based on image data representing a plurality of frame images successively displayed on the liquid crystal display device, comprising:

a primary preceding frame image data reconstructor for generating primary reconstructed preceding frame image data representing an image of a preceding frame by compressing current frame image data representing an image of a current frame, delaying the compressed image data by one frame interval, and decompressing the delayed image data;

an amount-of-change calculation circuit for calculating an amount of change between the image of the current frame and the image of the preceding frame;

a secondary preceding frame image data reconstructor for generating secondary reconstructed preceding frame image data representing an image of the preceding frame, based on the current frame image data and said amount of change;

a reconstructed preceding frame image data generator for generating reconstructed preceding frame image data representing an image of the preceding frame, based on an absolute value of said amount of change, the primary reconstructed preceding frame image data, and the secondary reconstructed preceding frame image data; and a compensated image data generator for generating compensated image data having compensated values representing the image of the current frame, based on the current frame image data and the reconstructed preceding frame image data.

9. The image data processing circuit of claim 8, wherein:

the primary preceding frame image data reconstructor compresses the current frame image data by encoding the current frame image data and decompresses the delayed image data by decoding the delayed image data; and the amount-of-change calculation circuit decodes the encoded current frame image data to generate non-delayed decoded current frame image data and compares the primary reconstructed preceding frame image data with the non-delayed decoded current frame image data to calculate the amount-of-change.

10. The image data processing circuit of claim 8, wherein:

the primary preceding frame image data reconstructor compresses the current frame image data by quantizing the current frame image data and decompresses the delayed image data by restoring bits; and the amount-of-change calculation circuit compares the delayed image data with the quantized current frame image data to calculate the amount-of-change.

11. The image data processing circuit according to claim 8, wherein the reconstructed preceding frame image data generator selects the primary reconstructed preceding frame image data as the reconstructed preceding frame image data when the absolute value of said amount of change is larger than a predetermined threshold, and selects the secondary reconstructed preceding frame image data as the reconstructed preceding frame image data when the absolute value of said amount of change is smaller than the predetermined threshold.

12. The image data processing circuit according to claim 8, wherein the reconstructed preceding frame image data generator selects the primary reconstructed preceding frame image data as the reconstructed preceding frame image data when the absolute value of said amount of change is larger than a first predetermined threshold;

selects the secondary reconstructed preceding frame image data as the reconstructed preceding frame image data when the absolute value of said amount of change is smaller than a second predetermined threshold which is smaller than the first threshold; and combines the primary reconstructed preceding frame image data and the secondary reconstructed preceding frame image data in proportion to distances of said amount of change from the first threshold and the second threshold, when said amount of change is between the first threshold and the second threshold.

13. The image data processing circuit according to claim 8, wherein the compensated image data generator determines a difference between the current frame image data and the reconstructed preceding frame image data; and determines the compensated image data from said difference.

14. The image data processing circuit according to claim 13, wherein, in generating the compensated image data, the amount of compensation applied by the compensated image data generator to the current frame image data to generate the compensated image data when the difference is larger than a predetermined value, is larger than the amount of compensation applied by the compensated image data generator to the current frame image data to generate the compensated image data when the difference is smaller than the predetermined value, or no compensation is applied to the current frame image data to generate the compensated image data when the difference is smaller than said predetermined value.

15. The image data processing circuit according to claim 8, wherein the compensated image data generator comprises a lookup table to which the current frame image data and the reconstructed preceding frame image data are input.

16. The image data processing circuit according to claim 15, wherein the lookup table is preset to output compensation values based on the response time of the liquid crystal display device corresponding to arbitrary preceding frame image data and arbitrary current frame image data.

17. The image data processing circuit according to claim 16, wherein the compensated image data generator adds the compensation values to the current frame image data to generate the compensated image data.

18. The image data processing circuit according to claim 15, wherein the lookup table is preset to output the compensated image data.

19. The image data processing circuit according to claim 15, wherein the compensated image data generator reduces a number of bits of at least one of the current frame image data and the reconstructed preceding frame image data by quantization before input to the lookup table;

determines interpolation coefficients when reducing the number of bits, based on a positional relation of the image data before the bit reduction to thresholds used for the bit reduction; and carries out interpolation on the output of the lookup table by using the interpolation coefficients.

20. A liquid crystal display device including the image data processing circuit of claim 8 and a display unit for displaying an image according to the compensated image data generated by the compensated image data generator.

* * * * *